US007616527B2

(12) United States Patent
Tamura et al.

(10) Patent No.: US 7,616,527 B2
(45) Date of Patent: Nov. 10, 2009

(54) ELECTRONIC TIMEPIECE WITH CALENDAR FUNCTION AND CONTROL METHOD FOR SAME

(75) Inventors: Shuichi Tamura, Matsumoto (JP); Takashi Kawaguchi, Shiojiri (JP); Joji Kitahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 509 days.

(21) Appl. No.: 11/062,469

(22) Filed: Feb. 22, 2005

(65) Prior Publication Data

US 2005/0185513 A1 Aug. 25, 2005

(30) Foreign Application Priority Data

Feb. 19, 2004 (JP) ..... 2004-043462
Feb. 19, 2004 (JP) ..... 2004-043497
Oct. 12, 2004 (JP) ..... 2004-297139

(51) Int. Cl.
*G04B 19/20* (2006.01)

(52) U.S. Cl. ..... 368/37; 368/28

(58) Field of Classification Search ..... 368/28–29, 368/35–38

See application file for complete search history.

(56) References Cited

U.S. PATENT DOCUMENTS 3,992,868 A 11/1976 Tamaru et al.
4,271,494 A 6/1981 Miyazaki
4,282,592 A 8/1981 Miyasaka
5,274,616 A 12/1993 Shu et al.
5,305,289 A 4/1994 Besson et al.
6,088,300 A * 7/2000 Nakajima et al. ..... 368/28
6,128,252 A 10/2000 Nosaka
6,278,661 B1 8/2001 Higuchi et al.
6,307,814 B1 * 10/2001 Farine et al. ..... 368/80
6,766,459 B2 * 7/2004 Shimura et al. ..... 713/320
7,027,360 B2 4/2006 Kitahara et al.
2003/0198139 A1 * 10/2003 Kitahara et al. ..... 368/28

FOREIGN PATENT DOCUMENTS

EP 1115044 A 7/2001
EP 1341063 A 9/2003
JP S53-69082 6/1978
JP S55-82080 A 6/1980
JP S60-173491 A 9/1985
JP S62-182691 A 8/1987
JP H11-231071 A 8/1999
JP 2003-167072 A 6/2003
JP 2003-255063 A 9/2003

* cited by examiner

*Primary Examiner*—Vit W Miska
*Assistant Examiner*—Sean Kayes
(74) *Attorney, Agent, or Firm*—Global IP Counselors, LLP

(57) ABSTRACT

An electronic timepiece with a calendar display function that drives a piezo-electric actuator to drive a rotation of a piezo-electric rotor, and stops the drive of the piezo-electric actuator when the amount of the piezo-electric rotor advances is detected by a spring switch. Photoreflectors are used for day detection accomplished using gears having a small speed reduction ratio relative to the piezo-electric rotor, and spring switches are used in month detection and year detection.

22 Claims, 16 Drawing Sheets

| PT3 | PT2 | PT1 | PT0 | 2-digit display | 1-digit display | Comment |
|---|---|---|---|---|---|---|
| L | X | L | L | 00or10 | 2~8 | |
| L | X | L | H | 00or10 | 9 | |
| L | X | H | L | 00or10 | 0 | day 00 nonexistent |
| L | X | H | H | 00or10 | 1 | |
| H | L | L | L | 20 | 2~8 | |
| H | L | L | H | 20 | 9 | |
| H | L | H | L | 20 | 0 | |
| H | L | H | H | 20 | 1 | |
| H | H | L | L | 30 | 2~8 | days 32~38 nonexistent |
| H | H | L | H | 30 | 9 | day 39 nonexistent |
| H | H | H | L | 30 | 0 | |
| H | H | H | H | 30 | 1 | |

X: Don't care

FIG. 6

| CS2 | Display | Comment |
|---|---|---|
| H | 0 | Leap year |
| L | 1、2、3 | Non-leap year |

FIG. 7

| CS1 | CS0 | Display | Comment |
|---|---|---|---|
| L | X | 1、3、5、7、8、10、12 | Long month |
| H | L | 4、6、9、11 | Short month |
| H | H | 2 | |

FIG. 9

| PT3 | PT2 | PT1 | PT0 | 2-digit display | 1-digit display | Comment |
|---|---|---|---|---|---|---|
| L | X | L | L | 00or10 | 2~8 | |
| L | X | L | H | 00or10 | 9 | |
| L | X | H | L | 00or10 | 0 | day 00 nonexistent |
| L | X | H | H | 00or10 | 1 | |
| H | L | L | L | 20 | 2~8 | |
| H | L | L | H | 20 | 9 | |
| H | L | H | L | 20 | 0 | |
| H | L | H | H | 20 | 1 | |
| H | H | L | L | 30 | 2~8 | days 32~38 nonexistent |
| H | H | L | H | 30 | 9 | day 39 nonexistent |
| H | H | H | L | 30 | 0 | |
| H | H | H | H | 30 | 1 | |

X: Don't care

FIG. 15

| PT3 | PT2 | PT1 | PT0 | 2-digit display | 1-digit display | Comment |
|---|---|---|---|---|---|---|
| L | X | L | L | 00or10 | 2~8 | |
| L | X | L | H | 00or10 | 9 | |
| L | X | H | H | 00or10 | 0 | day 00 nonexistent |
| L | X | H | L | 00or10 | 1 | |
| H | L | L | L | 20 | 2~8 | |
| H | L | L | H | 20 | 9 | |
| H | L | H | H | 20 | 0 | |
| H | L | H | L | 20 | 1 | |
| H | H | L | L | 30 | 2~8 | days 32~38 nonexistent |
| H | H | L | H | 30 | 9 | day 39 nonexistent |
| H | H | H | H | 30 | 0 | |
| H | H | H | L | 30 | 1 | |

X : Don't care

FIG. 16

| PT1 | PT0 | Display | Comment |
|---|---|---|---|
| L | L | 1~28 | |
| L | H | 29 | Correction: non-leap year Feb |
| H | L | 30 | Correction:Feb |
| H | H | 31 | Correction: non-long month |

FIG. 17

| PT1 | PT0 | Display | Comment |
|---|---|---|---|
| L | L | 1~28 | |
| L | H | 29 | Correction: non-leap year Feb |
| H | H | 30 | Correction: Feb |
| H | L | 31 | Correction: non-long month |

ELECTRONIC TIMEPIECE WITH CALENDAR FUNCTION AND CONTROL METHOD FOR SAME

BACKGROUND OF THE INVENTION

1. Field of the Invention

The present invention generally relates to an electronic timepiece provided with a calendar function. More specifically, the present invention relates to an electronic timepiece provided with a calendar function, for example, an electronic timepiece with calendar function capable of automatic end of the month correction, and a control method for the same.

2. Background Information

Electronic timepieces with a calendar mechanism to display a calendar (electronic timepiece with calendar function) are well known. The calendar display mechanism of the timepiece provides a mechanism to rotate a calendar display wheel such as a day panel (day display wheel), for example, on which are arranged numerals 1 through 31 on the circular periphery thereof, the rotation being accomplished through a gear system in conjunction with the rotation of a rotor. Further, an actuator controls the amount of rotation of the rotor to rotate the day wheel one day.

Electronic timepieces provided with such a calendar display mechanism are further provided with an end of the month correction function to avoid a remainder display at the end of those months which have fewer than 31 days (February, April, June, September, November) because days are only incremented one day at a time, and the nonexistent remaining days are actually displayed. For an example, please refer to WIPO Publication WO99/34264 and Japanese Laid-Open Patent Publication No. 2003-25563, which are hereby incorporated by reference. Specifically, when the calendar display mechanism is a mechanism which displays year, month, and day, a day detecting part and month detecting part are respectively provided to detect the displayed month and day in conjunction with the amount of rotation of the day panel and month panel or the like; after the day is advanced, the currently displayed year, month, and day are detected by the day detecting part and month detecting part. Then, if the detected day is a nonexistent day, the actuator is controlled to rotate the day panel or the like until an existing day is displayed. Consequently, an accurate calendar date is displayed in the date window.

When the amount of rotation of the rotor is controlled by an actuator, the drive of the actuator and the detection of the amount of rotation of the rotor are accomplished in parallel. Conventionally, however, since a photoreflector (reflecting type photosensor) is used in the detection of the rotation of the rotor, there is concern that the rated current of the drive power source may be exceeded when the actuator and photoreflector are driven simultaneously (that is, when the calendar is advanced). This problem is particularly pronounced when a secondary battery is used in the drive power source.

In a timepiece provided with an end of the month correction function, the calendar displayed by the calendar display mechanism (calendar displayed in the display window of the timepiece) must be detected, and whether the detected date includes an existing day must be determined. A problem arises in this calendar detection inasmuch as considerable power is consumed when a plurality of photoreflectors is used. When many mechanical switches are used, however, a problem arises inasmuch as the service life of the mechanical switch is reduced, a large torque acts upon the gear train of the calendar display mechanism, and the power consumption of the actuator increases.

Conventionally, all calendar information displayed by the calendar display mechanism must be detected for end of the month correction. Therefore, there is an increase in the power consumed for calendar detection when the calendar displays a plurality of calendar information such as month, day and the like. When sensors, such as photoreflectors (reflecting type photosensors), are used, which have relatively large power consumption, the rated current of the drive power source may be exceeded when a plurality of detection parts are simultaneously operated. This problem is particularly pronounced when a secondary battery is used in the drive power source.

In view of the above, it will be apparent to those skilled in the art from this disclosure that there exists a need for an improved electronic device with a calendar function and control method for the same. This invention addresses this need in the art as well as other needs, which will become apparent to those skilled in the art from this disclosure.

SUMMARY OF THE INVENTION

In view of the aforesaid information, a first object of the present invention is to provide an electronic timepiece with a calendar display function and a control method for the same that are capable of improving the durability of the calendar detection sensors and reduce power consumption when the calendar is advanced.

A second object of the present invention is to provide an electronic timepiece with a calendar display function and a control method for same that are capable of reducing the power consumption required for end of the month correction.

These objects are realized by a first aspect of the present invention that provides an electronic timepiece with a calendar display function having a calendar display mechanism to rotate one or a plurality of calendar display wheels by the rotational drive of a rotor through a gear train. The rotor is rotated by the operation of an actuator, one or a plurality of calendar display wheels are rotated through the gear train including the rotor, one gear in the gear train is provided with a mechanical switch that operates in conjunction with the rotation of this gear. The amount of rotation of the rotor is detected by detecting the operation of the mechanical switch, and the drive of the actuator is stopped based on the detection result. According to this structure, since the amount of rotation of the rotor is detected by a mechanical switch and the drive of the actuator is stopped based on the detection result, current consumption can therefore be reduced when the drive of the actuator and the detection of the rotor advance occur simultaneously.

An electronic timepiece with a calendar display function in accordance with a second aspect of the present invention is the timepiece of the first aspect, wherein the mechanical switch preferably includes a spring contact provided on the gear, and a conduction member that provides conduction through the spring contact in accordance with the rotation of the gear.

An electronic timepiece with a calendar display function in accordance with a third aspect of the present invention is the timepiece of the first aspect, wherein the gear provided with the mechanical switch is a gear in a reduction gear train.

An electronic timepiece with a calendar display function in accordance with a forth aspect of the present invention is the timepiece of the first aspect, that includes a plurality of detection wheels formed of the calendar display wheels or gears that rotate in linkage with the calendar display wheels. Further, among the plurality of detection wheels, a noncontact detector that provides noncontact-type detection of the rotation position is provided for detection wheels having several detection patterns of the displayed calendar and/or detection wheels having a small speed reduction ratio relative to the rotor. Moreover, a contact detector that provides contact-type detection of the rotation position of the wheel is provided for the remaining detection wheels. The date displayed by the calendar display wheel is detected based on the detection results of the noncontact detector and the contact-type detector. According to this structure, since the noncontact detector for noncontact-type detection of the rotation position is provided for detection wheels having several detection patterns of the displayed calendar and/or detection wheels having a small speed reduction ratio relative to the rotor, and contact detector for contact-type detection of the rotation position of the wheel is provided for the remaining detection wheels, the durability of the calendar detection sensors is therefore enhanced, torque load of the spring switch on the calendar detection wheel is reduced, and power consumption is reduced.

An electronic timepiece with a calendar display function in accordance with a fifth aspect of the present invention is the timepiece of the fourth aspect, wherein the calendar display wheel includes a day wheel to display the day, and the noncontact detector detects whether the displayed day conforms to at least any of the detection patterns including 31, 30, 29, or 1-28.

An electronic timepiece with a calendar display function in accordance with a sixth aspect of the present invention is the timepiece of the fourth or fifth aspect, wherein the contact-type detector includes a spring contact provided on a detection wheel, and a conduction member which provides conduction through the spring contact in accordance with the rotation of the detection wheel. Further, noncontact detector is configured to read an optical detection pattern or magnetic detection pattern provided on the calendar display wheel or gear by optical detection or magnetic detection.

A control method for an electronic timepiece with a calendar display function provided with a calendar display mechanism to rotate one or a plurality of calendar display wheels by the rotational drive of a rotor through a gear train in accordance with a seventh aspect of the present invention is provided. In this method, the amount of rotation of the rotor is detected by detecting the operation of a mechanical switch that operates in conjunction with the rotation of one gear in the gear train. Further, the drive of the actuator that rotates the rotor is stopped based on the detection result. According to this structure, since the amount of rotation of the rotor is detected by a mechanical switch and the drive of the actuator is stopped based on the detection result, current consumption can therefore be reduced when the drive of the actuator and the detection of the rotor advance occur simultaneously.

A control method in accordance with an eighth aspect of the present invention is the method of the seventh aspect, wherein detection of the date displayed by the calendar display wheel is detected based on the detection results of the noncontact detector and the contact detector. The noncontact detector is provided for noncontact-type detection of the rotation position for detection wheels having several detection patterns of the displayed calendar and/or detection wheels having a small speed reduction ratio relative to the rotor. The contact detector is provided for contact-type detection of the rotation position of the wheel for the remaining detection wheels, among a plurality of detection wheels formed of the calendar display wheels or gears which rotate in linkage with the calendar display wheels. According to this structure, power consumption can be reduced during calendar detection.

A ninth aspect of the present invention provides an electronic timepiece with a calendar display function including a calendar display to display a plurality of calendar information, a drive device to drive the calendar display and to change a plurality of calendar information, and a control means to detect one bit calendar information among a plurality of calendar information bits displayed by the calendar display. The control also determines whether the one bit of calendar information conforms to predetermined and set calendar information requiring end of the month correction, detects other calendar information only when the one bit of calendar information has been determined to conform to the set calendar information, determines whether the date of the detected calendar information is an existing day or nonexistent day, and controls the drive device to display an existing day on the calendar display when a nonexistent day has been determined. According to this structure, since one bit of calendar information is detected among a plurality of displayed calendar information bits, and a determination is made as to whether the one bit of calendar information conforms to the set calendar information requiring end of the month correction, and the other calendar information is detected only when the one calendar information has been determined to conform to the set calendar information, power consumption can therefore be reduced by that portion used for the detection of other calendar information when the initially detected calendar information is information which does not require end of the month correction.

A electronic timepiece with a calendar display function in accordance with a tenth aspect of the present invention is the timepiece of the ninth aspect, wherein the plurality of calendar information bits includes at least the month and day information. Further, the control detects the month from among the plurality of calendar information bits displayed by the calendar display, detects other calendar information including the day only when the month has been determined to conform to the set calendar information in which the month is a month having fewer than 31 days, determines whether the date including this month and day is an existing day or nonexistent day, and controls the drive device display an existing day on the calendar display when a nonexistent day is determined.

An electronic timepiece with a calendar display function in accordance with an eleventh aspect of the present invention is the timepiece of the ninth aspect, wherein the plurality of calendar information bits includes at least month and day information. Further, the control detects the day from among the plurality of calendar information bits displayed by the calendar display, detects other calendar information including the month only when the day has been determined to conform to the set calendar information in which the day is a day which does not exist in a month having fewer than 31 days, determines whether the date including this month and day is an existing day or nonexistent day, and controls the drive device to display an existing day on the calendar display when a nonexistent day is determined.

An electronic timepiece with a calendar display function in accordance with a twelfth aspect of the present invention is timepiece of the tenth or eleventh aspects, wherein the plurality of calendar information bits includes the year. Further, the control detects the year only when the detected month is February and the detected day is not day 1-28, determines whether the date representing this year, month, and day is an existing day or nonexistent day, and controls the drive device to display an existing day on the calendar display when a nonexistent day is determined.

An electronic timepiece with a calendar display function in accordance with a thirteenth aspect of the present invention is the timepiece of the tenth aspect, wherein the calendar display includes a tens-column place value display to display the tens-column value of a day, and a ones-column place value display to display the ones-column value of a day to display the day by the tens-column display and the ones-column display. Further, when detecting the day, the control detects the tens-column value of that day, determines whether the tens-column value of that day conforms to a tens-column value of 1 or 0 which invariably exists in short months and long months, and detects the ones-column value of that day only when the tens-column value is not 1 or 0.

An electronic timepiece with calendar a display function in accordance with a fourteenth aspect of the present invention is the timepiece of the tenth aspect, wherein, the calendar display includes a tens-column place value display to display the tens-column value of a day, and a ones-column place value display to display the ones-column value of a day to display the day by respectively rotating the tens-column display and the ones-column display. Further, two photoreflectors are arranged on the back side of the tens-column display separated by an open space on a common circle periphery in the rotation direction of the tens-column display, and a light detection pattern having a reflective region and nonreflective region is provided on the back surface of the tens-column display such that the detection results of the two photoreflectors are different when the day displayed on the tens-column display is any among 0-10, 20, and 30. Further, two photoreflectors are arranged on the back side of the ones-column display separated by an open space on a common circle periphery in the rotation direction of the ones-column display, and a light detection pattern having a reflective region and nonreflective region is provided on the back surface of the ones-column display such that the detection results of the two photoreflectors are different when the day displayed on the ones-column display is any among 2-8, 9, 0, and 1.

An electronic timepiece with a calendar display function in accordance with a fifteenth aspect of the present invention is the timepiece of the fourteenth aspect, wherein the two more photoreflectors disposed on the back side of the ones-column place value display are arranged with the same spacing as the spacing of the days of the ones-column provided on the ones-column display. Further, the optical detection pattern on the ones-column display includes a reflective region extending across the illumination range of the two photoreflectors when the day displayed by the ones-column display is 0, and a nonreflective region extending across the illumination range of the two photoreflectors outside the reflective region.

An electronic timepiece with a calendar display function in accordance with a sixteenth aspect of the present invention is the timepiece of the tenth aspect, wherein the calendar display includes a day display to display 1-31 days, and the day is displayed by rotating the day display. Further, two photoreflectors are arranged on the back side of the day display separated by an open space on a common circle periphery in the rotation direction of the day display. Moreover, a light detection pattern having a reflective region and a nonreflective region is provided on the back surface of the day display such that the detection results of the two photoreflectors are different when the day displayed on the day display is any among 10-28, 29, 30, and 31.

An electronic timepiece with a calendar display function in accordance with a seventeenth aspect of the present invention is the timepiece of the sixteenth aspect, wherein the two photoreflectors disposed on the back side of the day display are arranged with the same spacing as the spacing of the days provided on the day display, and the optical detection pattern on the day display includes a reflective region extending across the illumination range of the two photoreflectors when the day displayed by the day display is (30), and a nonreflective region extending across the illumination range of the two photoreflectors outside the reflective region.

An eighteenth aspect of the present invention provides a control method for an electronic timepiece with a calendar display function having a calendar display to display a plurality of calendar information bits, and a drive device to drive the calendar display and to change the plurality of calendar information bits of the display. Further, one bit calendar information is detected among a plurality of calendar information displayed by the calendar display, whether the one bit calendar information conforms to set calendar information requiring end of the month correction is determined. Event further, other calendar information is detected only when the one bit of calendar information has been determined to conform to the set calendar information, and whether the date of the detected calendar information is an existing day or nonexistent day is determined. Moreover, the drive device is controlled to display an existing day on the calendar display when a nonexistent day has been determined. According to this structure, since one bit of calendar information is detected among a plurality of calendar information bits displayed by the calendar display, a determination is made as to whether the one bit of calendar information conforms to set calendar information requiring end of the month correction, and other calendar information is detected only when the one calendar information has been determined to conform to the set calendar information, power consumption can therefore be reduced by that portion used for the detection of other calendar information when the initially detected calendar information is information which does not require end of the month correction.

A control method in accordance with a nineteenth aspect of the present invention is the method of eighteenth aspect, wherein the plurality of calendar information bits includes at least month and day, and the month is detected from among a plurality of calendar information bits displayed by the calendar display. Further, other calendar information including the day is detected only when the month has been determined to conform to the set calendar information in which the month is a month having fewer than 31 days, and whether the date including this month and day is an existing day or nonexistent day is determined. Moreover, the drive device is controlled to display an existing day on the calendar display means when a nonexistent day is determined.

A control method in accordance with a twentieth aspect of the present invention is the method of eighteenth aspect, wherein the plurality of calendar information bits includes at least the month and day, and the day is detected from among a plurality of calendar information bits displayed by the calendar display. Further, other calendar information including the month is detected only when the day has been determined to conform to the set calendar information in which the day is a day which does not exist in a month having fewer than 31 days, and whether the date including this month and day is an existing day or nonexistent day is determined. Moreover, the drive device is controlled to display an existing day on the calendar display when a nonexistent day is determined.

A control method in accordance with a twenty-first aspect of the present invention is the method of nineteenth or twentieth aspect, wherein the plurality of calendar information bits includes the year which is detected only when the detected month is February and the detected day is not day 1-28. Further, whether the date representing this year, month, and day is an existing day or nonexistent day is determined, and the drive device is controlled to display an existing day on the calendar display means when a nonexistent day is determined.

A control method in accordance with a twenty-second aspect of the present invention is the method of nineteenth aspect, wherein, the calendar display includes a tens-column place value display to display the tens-column value of a day, and a ones-column place value display to display the ones-column value of a day to display the day by the tens-column display and the ones-column display. Further, when detecting the day, the tens-column value of that day is detected, whether the tens-column value of that day conforms to a tens-column value of 1 or 0 which invariably exists in short months and long months is determined, and detects the ones-column value of that day only when the tens-column value is not 1 or 0.

According to the present invention as described above, one gear in the calendar display mechanism is provided with a mechanical switch which operates in conjunction with the rotation of this gear, the calendar display mechanism is driven by the rotation of a rotor driven by an actuator, the amount of rotation of the rotor is detected by detecting the operation of the mechanical switch, and the drive of the actuator is stopped based on the detection result. Thus, current consumption can be reduced when the drive of the actuator and the detection of the rotor advance occur simultaneously. Further, according to the present invention, power consumption can be reduced by detecting one bit among a plurality of displayed calendar information bit, determining whether this detected calendar information conforms to set calendar information which requires end of the month correction, detecting other calendar information only when the one bit of calendar information has been determined to conform to the set calendar information, and determining whether the date of the detected calendar information is an existing day or nonexistent day.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 6 is a view of a table showing an example of a year information detection pattern for the wristwatch;

FIG. 7 is a view of a table showing an example of a month information detection pattern for the wristwatch;

FIG. 9 is a view of a table showing an example of a day information detection pattern for the wristwatch;

FIG. 15 is a view of a table showing an example of a modification of the day information detection pattern of the wristwatch of the second embodiment;

FIG. 16 is a view of a table showing another example of a modification of the day information detection pattern; and FIG. 17 is a view of a table showing still another example of a modification of the day information detection pattern.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The preferred embodiments of the present invention are described hereinafter with reference to the accompanying drawings. In these embodiments, the present invention is applied to a wristwatch. In the following description, all dates conform to the solar calendar.

First Embodiment

Figure 1:
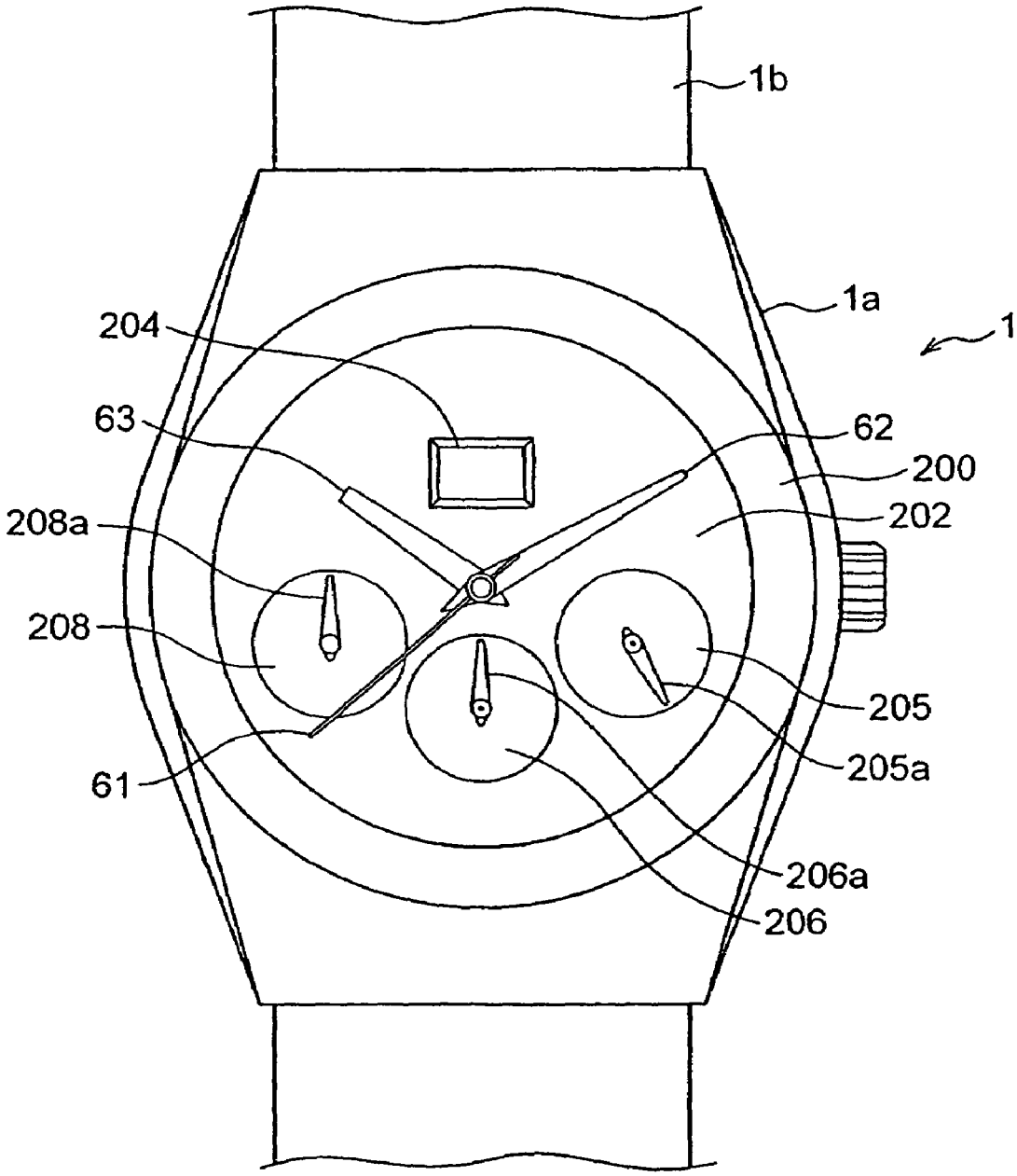
FIG. 1 is a plain view that illustrates an external structure of in accordance with a first preferred embodiment of the present invention.

FIG. 1 shows an external structure of an embodiment of a wristwatch 1 in accordance with a first preferred embodiment of the present invention. As shown in FIG. 1, a wristwatch 1 is provided with a watchcase 1*a* and band 1*b* linked to the watchcase 1*a*. The watchcase 1*a* is provided with a housing 200, and disk-like watchface 202 provided on the housing 200. Three display hands including a second hand 61, a minute hand (long needle) 62, and an hour hand (short needle) 63, are provided on the top surface of the housing 200. Symbols representing time are arranged at equal intervals around the circumference of the watchface 202, and the current time is displayed by the numbers or symbols (in the present embodiment, symbols include letters) indicated by each display indicator needle.

On the watchface there are also provided an approximately square-slotted day display window 204, a 24-hour display 205, a month display 206, and a year display 208. Any numeral from 1 through 31 representing the calendar day can be displayed in the day display window 204. In this case, day wheels (calendar display wheels) are provided separately for the ones-column place value number and the tens-column place value number, and the calendar day is displayed by the numeral of each wheel, as described later. Symbols representing time divided into 24 equal portions are arranged at equal intervals along the circumference of the 24-hour display 204, and the time or hour of the day is displayed by the symbol indicated by the display hand 205*a*.

Single symbols representing a calendar month, for example, JAN (representing the first month) through DEC (representing the twelfth month), are arranged at equal intervals along the circumference of the month display 206, and the calendar month is displayed by the symbol indicated by the display hand 206*a*. Any one numeral from 0 to 3 is displayed at equal intervals along the circumference of the year display 208. In the case of a leap year, the numeral 0 is indicated by the display hand 208*a*, and when subsequent numerals 1, 2, and 3 are indicated, they represent the number of years since the leap year. Consequently, the user is made aware of the calendar year.

Figure 4:
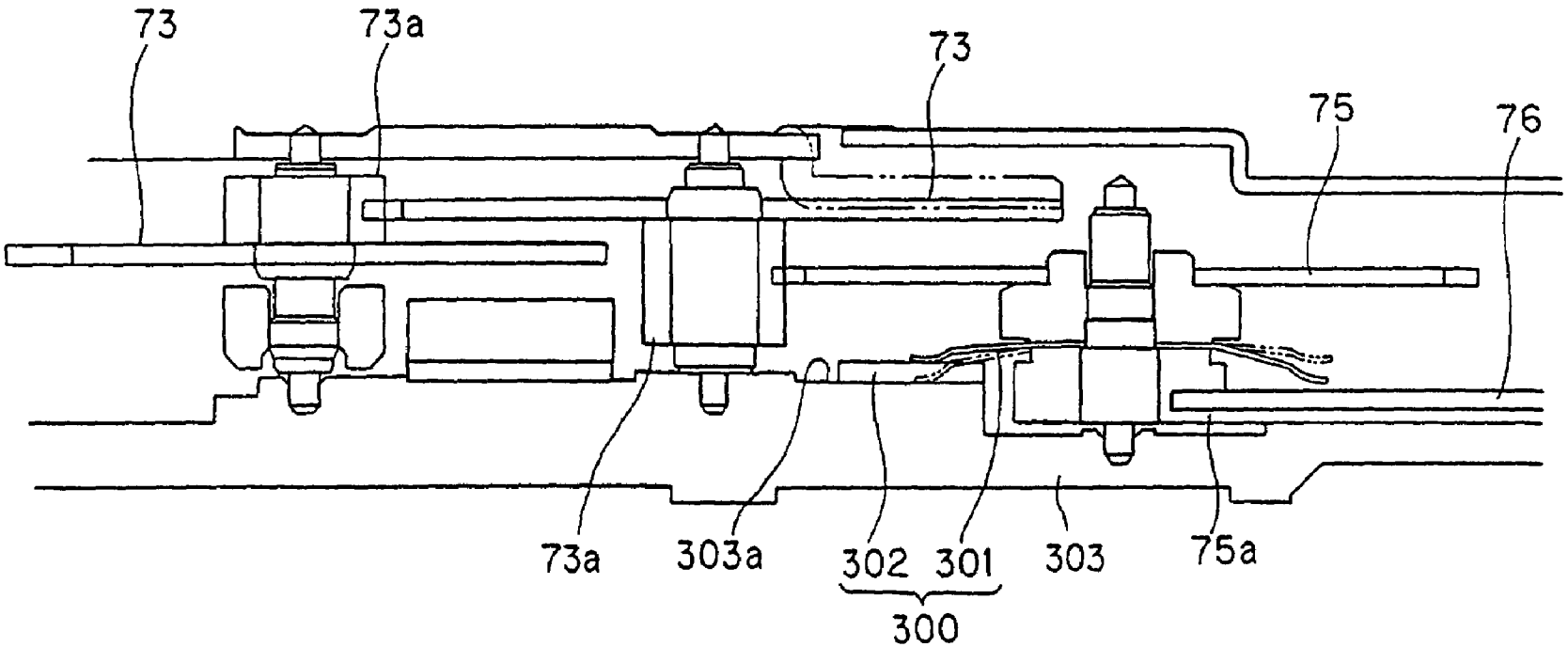
FIG. 4 is a elevational view illustrating a spring switch used to detect the amount of rotor advance in the automatic calendar mechanism.

Referring now to FIGS. 1 and 4, a disk-shaped ground plate 303 (FIG. 4), having the approximate shape of the watchface 202, is disposed within the watchcase 1*a*, and an automatic calendar mechanism (calendar display) is arranged on the front side of the watch and a basic mechanism as a clock is arranged on the back side such that the ground plate 303 is interposed therebetween. The ground plate 303 functions as a part to support one end of each gear of the automatic calendar mechanism.

Figure 2:
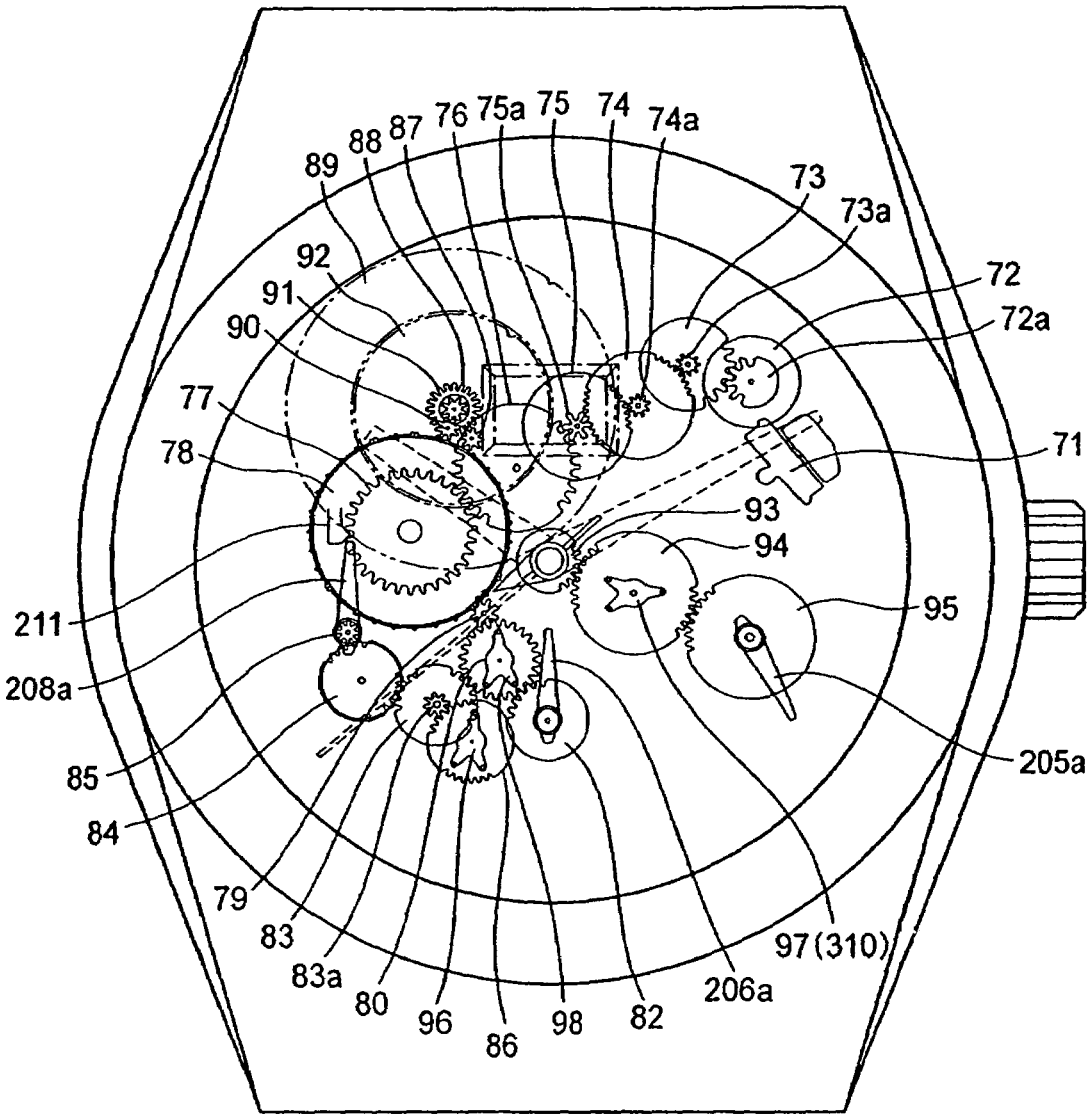
FIG. 2 is a plain view that shows the automatic calendar mechanism of the wristwatch.
Figure 3:
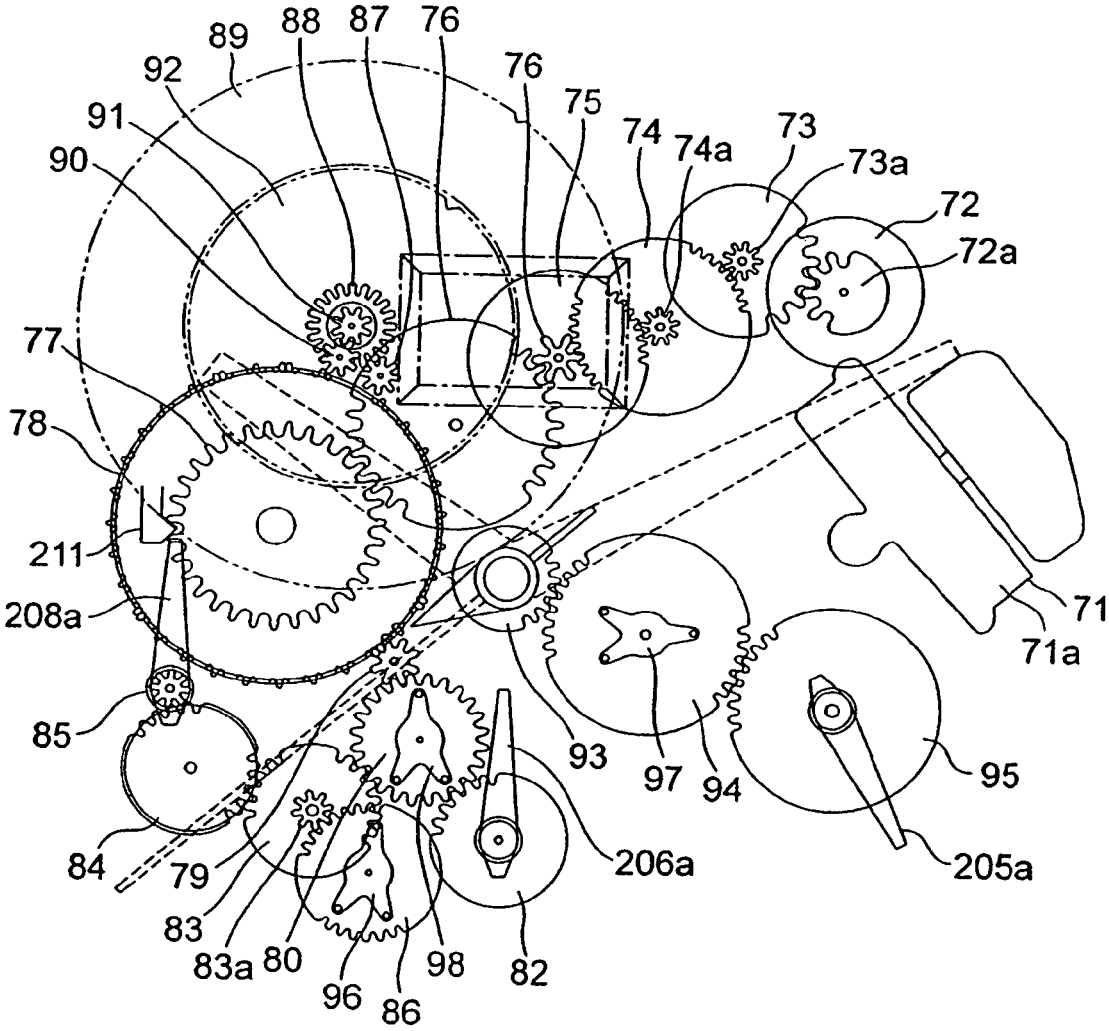
FIG. 3 is enlarged plain view of the automatic calendar mechanism.

FIG. 2 shows the automatic calendar mechanism, and FIG. 3 is an enlargement of same. The automatic calendar mechanism is supported on one surface, the front side of the watch 1, of the ground plate 303. Further, the drive source of the automatic calendar mechanism is a piezo-electric actuator (drive device) 71. The piezo-electric actuator 71 is provided with a piezo-electric element as an oscillating element such that a rotor 72 is rotated by the oscillation of the piezo-electric element thrusting the outer edge of the rotor 72. The rotor 72 is provided with an integrated rotor undercutter 72*a*, an intermediate wheel 73 that engages the rotor undercutter 72*a*, and an intermediate wheel 74 that engages an intermediate wheel 73*a*. An intermediate wheel 75 engages an intermediate undercutter 74*a* of the intermediate wheel 74, and an intermediate wheel 76 engages an intermediate undercutter 75*a* of the intermediate wheel 75. The intermediate wheel 76 engages a control wheel undercutter 77. Further, the control wheel undercutter 77 is integratedly formed with a control wheel 78. The reduction gear train up to this point rotates the control wheel 78. Reference number 211 refers to a jumper to position the control wheel undercutter 77.

Figure 10:
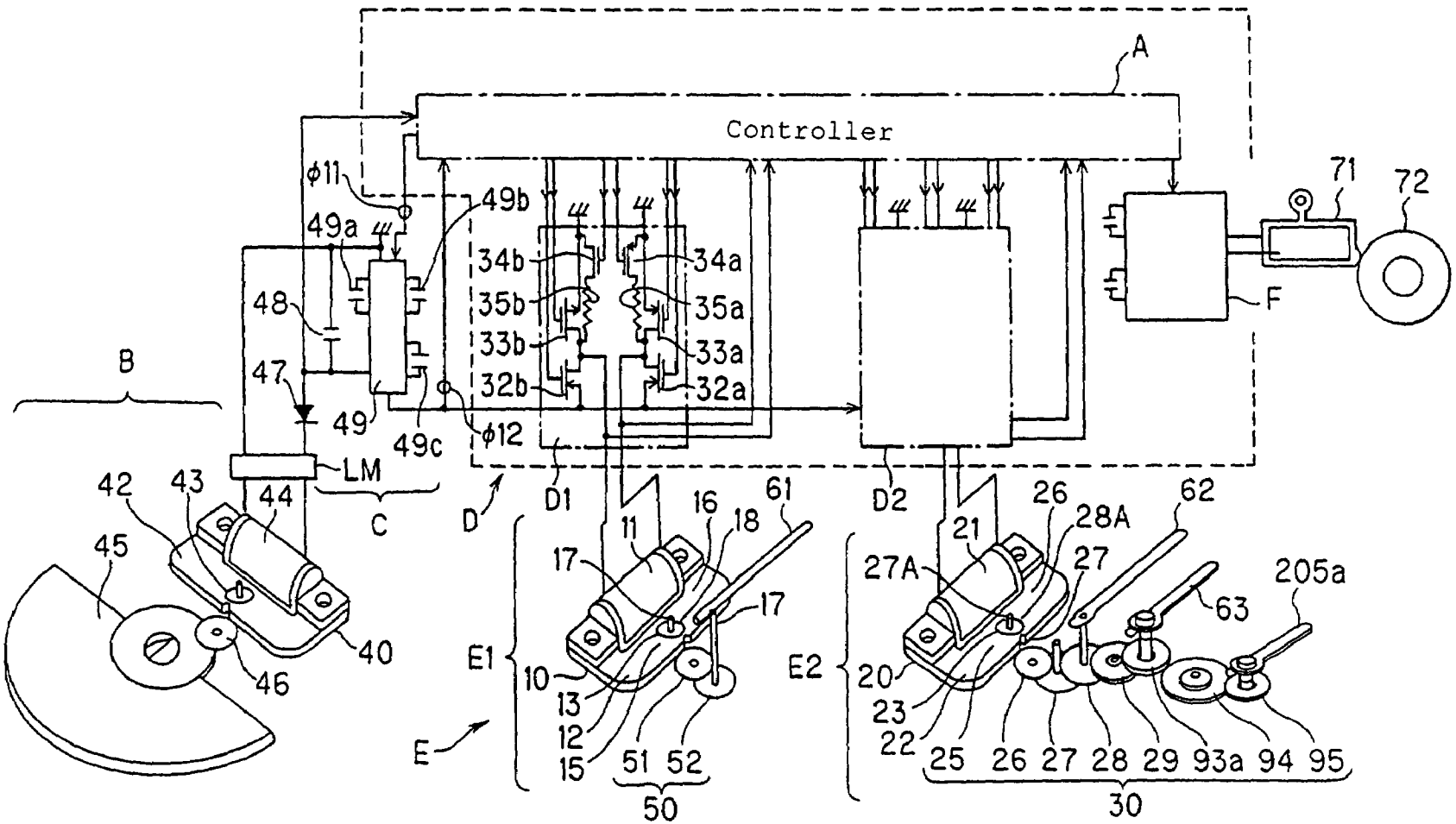
FIG. 10 is a combined perspective view and diagrammatical view showing both the electric structure and mechanical structure of the wristwatch.

Furthermore, referring now to FIGS. 2 to 4, a spring switch 300 to detect the amount the rotor 72 advances is provided on the intermediate wheel 75. The spring switch 300 is a mechanical switch that operates in conjunction with the rotation of the intermediate wheel 75. As shown in FIG. 4, the spring switch 300 is formed of a flexible metal material, for example, phosphor bronze, stainless steel or the like. The spring switch 300 includes a spring contact 301 fixedly attached to the support shaft of the intermediate wheel 75, and a conduction terminal 302, which is provided on a circuit board 303*a* of the ground plate 303, to provide conduction through the spring contact 301, which rotates together with the intermediate wheel 75. The conduction terminal 302 is formed as part of the layout pattern of the circuit board 303*a* to switch from a state (closed condition) to a nonconduction state (open condition) through the spring contact 301 each time the rotor 72 advances one day, that is, each time the intermediate wheel 75 rotates a specific angle corresponding to the amount the rotor 75 advances. As shown in FIG. 10, the conduction terminal 302 is connected to a controller A described later. The controller A detects when the rotor 75 advances one day by detecting when the spring switch 300 changes from the open state to the closed state. That is, the spring switch 300 functions as a rotor advancement detector to detect the amount by which the rotor 75 advances.

Referring again to FIGS. 2 to 4, the control wheel 78 has a plurality of ratchet wheels with different numbers of teeth. As seen in FIG. 2, these ratchet wheels respectively engage a day rotation wheel 87 positioned above the control wheel 78, and rotates the ones-column day wheel (ones-column display (calendar display wheel)) 89, day rotation wheel 90 to rotate the tens-column day wheel (tens-column display (calendar display wheel)) 92, and a month display intermediate wheel 79, positioned below the right of the control wheel 78 in the drawing, that ultimately rotates the month wheel (calendar display wheel)) 82. Numerals 0 through 9 are displayed at equal intervals in the circumferential direction on the exterior periphery of the ones-column day wheel 89, and a blank region and numerals 1 through 3 are displayed at equal intervals in the circumferential direction on the exterior periphery of the tens-column day wheel 92. The blank region on which no numerals are written, is placed at the tens-column position when the certain days correspond to the ones-column day, that is, days 1-9.

Referring now to FIGS. 1 and 3, the numerals 1 through 31 representing the calendar day are displayed in the previously mentioned day display window 204 by combining the numerals 0-9 on the ones-column day wheel 89, and the blank region and numerals 1-3 on the tens-column day wheel 92.

When the control wheel 78 rotates, first, the day rotation wheel 87 and ones-column pinion 88 rotate by way of the ones-column advance teeth of the gear corresponding to the ones-column day wheel 89. Further, and the ones-column day wheel 89 rotates integratedly with the wheel 87 and pinion 88, such that the numerals 0-9 on the exterior periphery of the day wheel 89 in principle advances in the circumferential direction such that one rotation is equated with one day. When the ones-column day wheel 89 rotates in conjunction with the rotation of the control wheel 78 and attains a date at which the tens-column advances, then at this time, the day rotation wheel 90 and tens-column day pinion 91 rotate by way of the tens-column advance teeth of the gear 10 corresponding to the tens-column day wheel 92. Further, the tens-column day wheel 92 rotates integratedly with the wheel 90 and pinion 91, such that the blank region or numerals 1-3 on the exterior periphery of the day wheel 92 advances in the circumferential direction such that one rotation is equivalent to ten days.

Furthermore, when the ones-column day wheel 89 and tens-column day wheel 92 rotationally advance in conjunction with the rotation of the control wheel 78 and attain a date at which the month display advances, then at this time the month display intermediate wheel 79 and month detection wheel 80 rotate by way of the month advance teeth of the gear corresponding to the month wheel 82, and the month wheel 82 rotates integratedly with the wheel 79 and wheel 80. Then, the display hand 206*a* rotates to indicate one symbol among the symbols JAN (representing the first month) through DEC (representing the twelfth month) that represent the calendar month on the month display wheel 206, such that the calendar month is displayed.

A year display intermediate wheel 83 engages the month detection wheel 80, and a year advance wheel 84 engages the year display intermediate wheel 83. Then, a year wheel (calendar display wheel) 85 engages the year advance wheel 84, and a display hand 208*a* which indicates the calendar year is connected to the year wheel 85. In this case, the year advance wheel 84 is constructed to rotate initially the year wheel 85 90° over a one year period. Accordingly, the display hand 208*a* rotates one rotation for each four year period. In the case of a leap year, the display hand 208*a* points to the numeral 0, and thereafter the hand 208*a* points to 1, 2, and 3, for example, displaying from the leap year to some year thereafter, such that the calendar year is displayed in this manner.

In other words, referring to FIGS. 1, 3, and 4, the automatic calendar mechanism is constructed to reduce the rotation speed of the rotor 72 through the gear train to rotate the control wheel 78, and respectively rotate the day wheels (ones-column day wheel 89 and tens-column day wheel 92), month wheel 82, and year wheel 85 through the rotation of the control wheel 78. In the present embodiment, since the spring switch 300 is provided for the intermediate wheel 75, which includes the gear train between the rotor 72 and control wheel 78, the torque load applied to the intermediate wheel 75 through the contact of the spring switch 300 with the spring contact 301 is much less than the rotational torque of the intermediate wheel 75. Therefore, the influence of this torque load on the rotation of the automatic calendar mechanism is minimized to the extent that impairment is eliminated.

Referring to FIGS. 1, 3, 4, and 10, in the 24-hour display 205, the drive force is different from the drive source of the automatic calendar mechanism, and this drive force is obtained from the drive source of the hand moving mechanism E of the timepiece disposed on the back side of the ground plate 303. In other words, a barrel wheel 93 is integrated with the barrel wheel of the hand moving mechanism E (the barrel wheel supporting the hour hand (short hand) 63), and a 24-hour detection wheel 94 engages the barrel wheel 93. A 24-hour detection wheel 95 engages the 24-hour detection wheel 94 such that the display hand 205*a* of the 24-hour display 205 is rotated by the rotation of the 24-hour wheel 95. The display hand 205*a* rotates one rotation per day.

Figure 11:
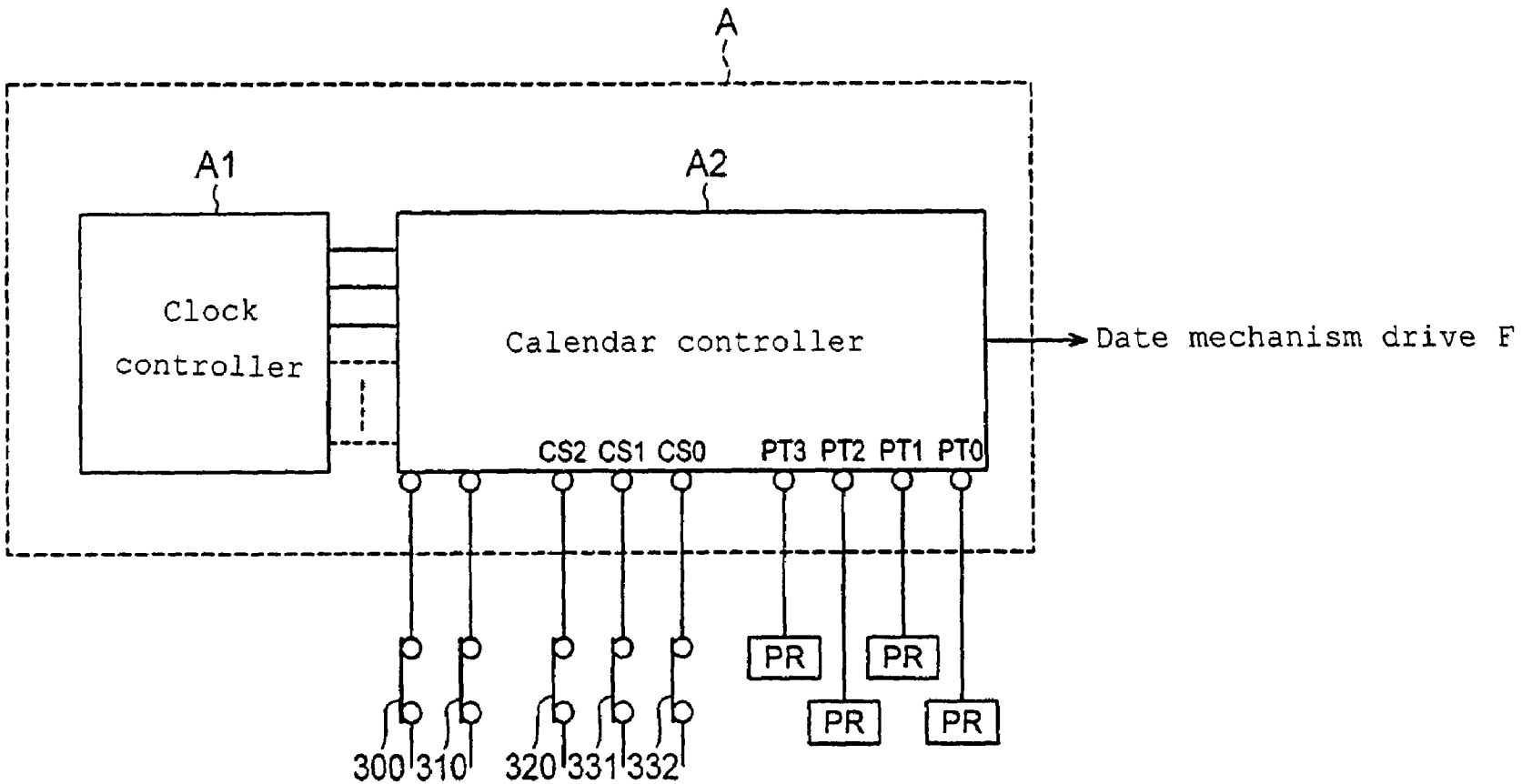
FIG. 11 is a view of a block diagram showing the function structure of a control unit of the wristwatch.

Referring now to FIGS. 2, 3, and 11, a spring switch 310, which is substantially similar to the spring switch 300 provided for the intermediate wheel 75, is provided for the 24-hour detection wheel 94, such that the indication of 12 o'clock midnight by the display hand 205*a* can be detected by this spring switch 310. Specifically, as shown in FIG. 2, a spring contact 97 is provided on the 24-hour detection wheel 94, and a conduction terminal (not shown in the drawing) is provided on the circuit board opposite the spring contact 97 to provide conduction through the spring contact 97 when the 24-hour detection wheel 94 is at the rotation position of 12 o'clock midnight. The operation of the spring switch 310 is detected by the controller A described later. In other words, the spring switch 310 functions as a 24-hour detector to detect 12 o'clock midnight.

The calendar detections (year detection, month detection, and day detection) are described below.

Figure 5:
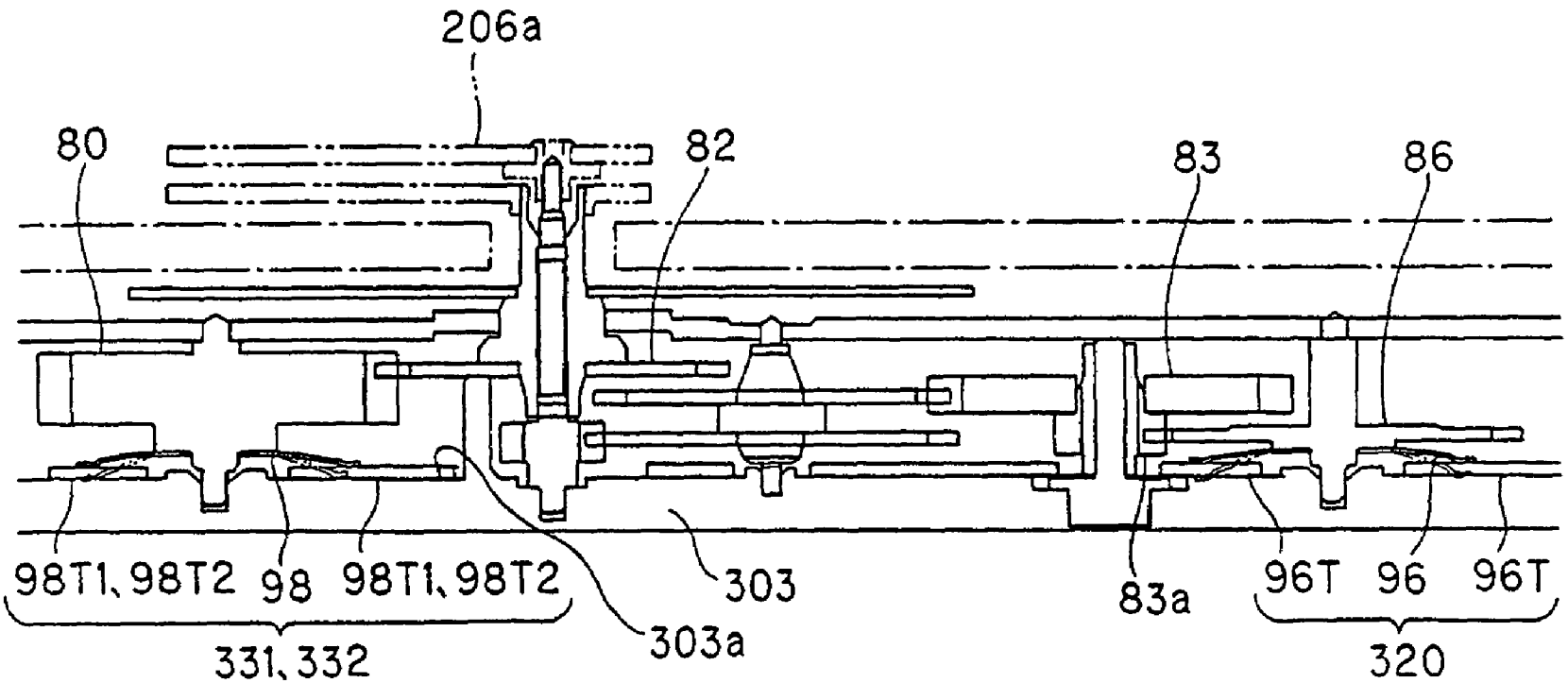
FIG. 5 is an elevational view illustrating a spring switch used for year detection and month detection in the automatic calendar mechanism.

Referring to FIGS. 3 and 5, in the above structure, a year detection wheel 86 engages an intermediate wheel pinion 83*a* of the year display intermediate wheel 83. Further, a spring switch 320, which is substantially similar to the spring switch 300, is provided on the year detection wheel (detection wheel) 86. Specifically, as shown in FIGS. 2 and 5, a spring contact 96 is provided on the year detection wheel 86, and a conduction terminal 96T is provided on the circuit board opposite the spring contact 96 to provided conduction through the spring contact 96 which rotates together with the year detection wheel 86 in conjunction with the rotation of the year detection wheel 86. Referring now to FIGS. 3, 5, and 11, the conduction terminal 96T is formed to provide conduction (closed state) or nonconduction (open state) by whether the displayed year is a leap year, and is connected to a terminal CS2 of the controller A described later. The controller A detects whether the pertinent year is a leap year or non-leap year (normal year) based on the year information detection pattern shown in FIG. 6 by detecting the operation (H-level or L-level) of the spring switch 320 through the terminal CS2. In other words, the year has two detection patterns.

Furthermore, as shown in FIGS. 3 and 5, the month detection wheel (detection wheel) 80 is provided with a spring switch 331 to detect whether the displayed month is a long month, and a spring switch 332 to detect whether the displayed month is a short month, excluding February. Specifically, as shown in FIGS. 2 and 5, a spring contact 98 is provided on the support shaft of the month detection wheel 80. Further, a conduction terminal 98T1 and a conduction terminal 98T2 are formed on the circuit board 303*a* opposite the spring contact 98. The conduction terminal 98T1 to provide conduction (closed state) or nonconduction (open state) when the displayed month is a long month, and the conduction terminal 98T2 to provides conduction (closed state) or nonconduction (open state) when the displayed month is a short month excluding February as a conduction terminal 98T to provide conduction through the spring contact 98 which rotates together with the month detection wheel 80. Referring now to FIGS. 3, 5, and 7, the conduction terminal 98T1 is connected to the terminal CS1 of the controller A, and the conduction terminal 98T2 is connected to the terminal CS0 of the controller A. The controller A detects whether the displayed month is February, a short month excluding February, or a long month based on the month information detection pattern shown in FIG. 7 by detecting the combined operation (H-level or L-level) of the spring switches 331 and 332 through the terminals CS1 and CS0. In other words, the month has three detection patterns.

Figure 8A:
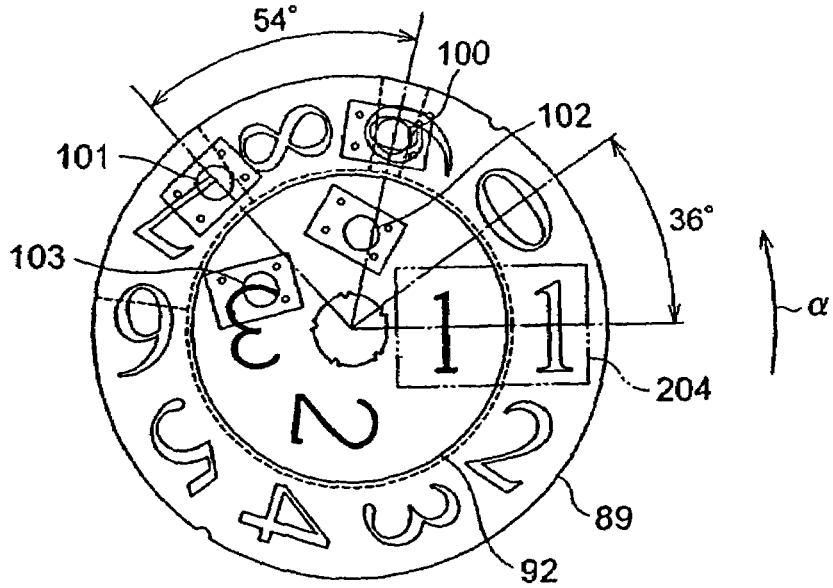
FIG. 8A is a view from the front of a day wheel of a ones-column place value and the day wheel of a tens-column place value of the wristwatch.
Figure 8B:
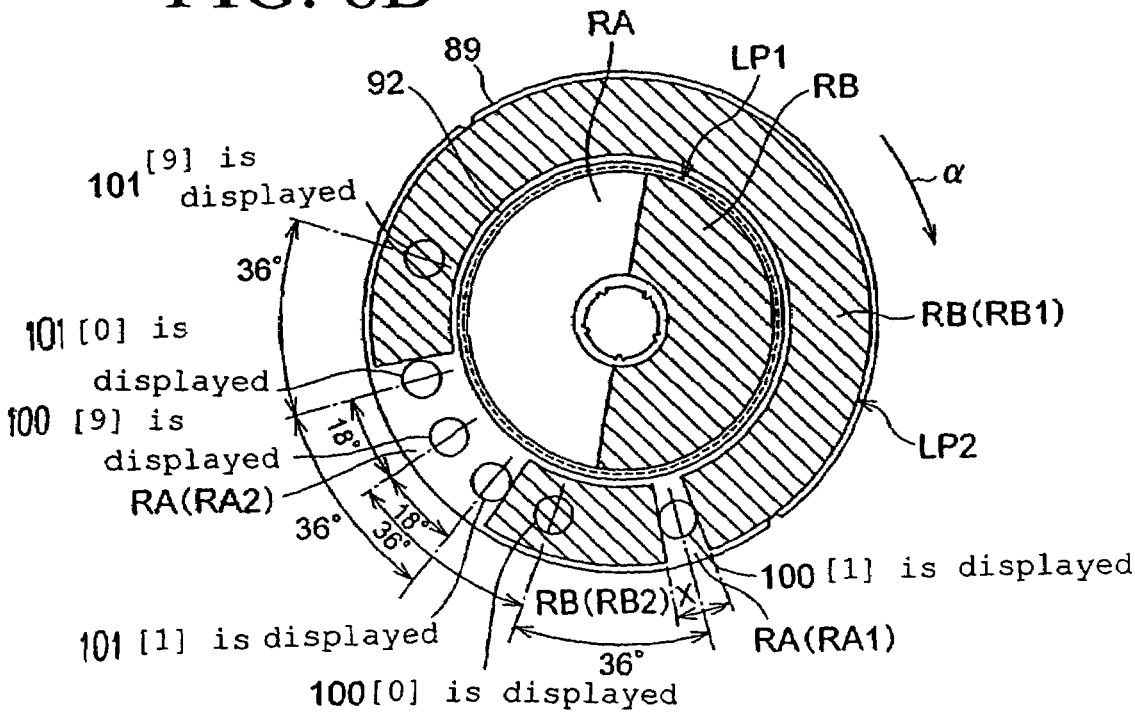
FIG. 8 B is a view from the back of the day wheel of the ones-column place value and the day wheel of the tens-column place value.

FIG. 8A shows the front of the ones-column day wheel 89 and the tens-column day wheel 92, and FIG. 8B shows the back of the respective day wheels 89 and 92. As shown in FIG. 8A, numerals 0-9 at equal interval spacing (36° intervals) on the front of the ones-column day wheel (detection wheel) 89 are arranged, and numerals 0-3 at equal interval spacing (90° intervals) on the front of the tens-column day wheel (detection wheel) 92 are arranged. Further, the day wheel 89 is rotationally driven in units of 36°, and the day wheel 92 is rotationally driven in units of 90°.

As shown in FIG. 8B, light detection patterns LP1 and LP2 are provided on the back of each day wheel 89 and 92, and a plurality of photoreflectors (reflective photosensors) 100, 101, 102, and 103 to read these patterns is provided on the board provided in the ground plate 303. Specifically, two photoreflectors 102 and 103, provided to illuminate light and to receive reflected light from different positions, are arranged on the board opposite the tens-column day wheel 92 separated by an open space on a common circle periphery in the rotation direction $\alpha$ of the day wheel 92. As shown in FIG. 8B, a light detection pattern LP1 is provided on the back of the day wheel 92. The light protection pattern LP1 switches from a reflective region RA to a nonreflective region RB at 180° intervals to discriminate the displayed day as 00 or 10, 20, or 30 by the photoreflectors 102 and 103. As shown in FIG. 11, the photoreflector 102 is connected to the terminal PT2 of the controller A, and the photoreflector 103 is connected to the terminal PT3 of the controller A.

Furthermore, referring to FIG. 8B, two photoreflectors 100 and 101 are arranged on the board opposite the ones-column day wheel 89 separated by an open space on a common circle periphery in the rotation direction $\alpha$ of the day wheel 89. On the back of the day wheel 89 is provided a light detection pattern LP2 to discriminate the displayed ones-column day as 2-8, 9, 0, or 1 by the photoreflectors 100 and 101. The photoreflectors 100 and 101 are arranged at angle intervals of 54° with reference to the rotational axis of the day wheel 89. As shown in FIG. 8B, the light detection pattern LP2 is formed to position the reflective region RA (RA2) in the illumination region of the photoreflector 100 and position the nonreflective region RB (RB1) in the illumination region of the photoreflector 101 when the day displayed in the day display window 204 is 9 (9 is the displayed time), and position the nonreflective region RB (RB2) in the illumination region of the photoreflector 100 and position the reflective region RA (RA2) in the illumination region of the photoreflector 101 when the day displayed in the day display window 204 is 0 (0 is part of the displayed date).

The light detection pattern LP2 is formed to position the reflective region RA (RA1) in the illumination region of the photoreflector 100 and to position the reflective region RA (RA2) in the illumination region of the photoreflector 101 when the day displayed in the day display window 204 is 1 (1 is the displayed time). The light detection pattern LP2 and additionally positions the nonreflective regions RB1 and RB2 in the illumination region of the photoreflector 100, and the reflective region RA (RA2) in the illumination region of the photoreflectors 100 and 101 when the day displayed in the day display window 204 is 2-8 (2-8 is part of the displayed time).

In this case, the reflective region RB1 is at a position illuminated only by the photoreflector 100. Since the range of the reflective region RA1 must be restricted such that the illumination region of the photoreflector 101 is the nonreflective region RB when the photoreflector 101 is nearest the reflective range RA1 (when 2-8 is the displayed time), the range X of the reflective range RA1 is less than the minimum pitch of the illumination range of the photoreflector 100 and the illumination range of the photoreflector 101, that is, a range less than 18°, which is half the numeral interval provided on the day wheel 89. As shown in FIG. 11, the photoreflector 100 is connected to the terminal PT0 of the controller A, and the photoreflector 101 is connected to the terminal PT1 of the controller A.

Consequently, referring to FIGS. 8A and 8B, in the present embodiment, since the discrimination of days 00 or 10, 20, 30, 2-8, 9, 0, and 1 displayed by the day wheels 89 and 92 is respectively accomplished by the two photoreflectors 100 and 101, and 102 and 103 arranged on a common circle periphery in the rotation direction of the respective day wheels 89 and 92, the photoreflectors 100 through 103 can be arranged within the major diameter of the day wheels even when the day wheels have small major diameters.

As shown in the day information detection pattern of FIG. 9 and in FIG. 10, the controller A detects whether the displayed tens-column day is 0 or 1, 2, or 3 based on the 2-bit information representing the photoreception result of the photoreflectors 102 and 103, and detects whether the displayed ones-column day is a ones-column day 2-8, or 9, 0, 1, which are days (29, 30, 31), at least one of which is not present in short months, and all which not usually being present in February. In other words, the day has twelve detection patterns. The detection patterns include nonexistent days (day 0, days 32-38, day 39), and since day detection is used for the determination of whether a day is an existing day (whether end of the month correction is required), at a minimum four types of detection patterns may be detected, including days 1-28, day 29, day 30, and day 31.

The embodiment described above provides a calendar detection mechanism having excellent durability, torque load reduction, and power consumption reduction by utilizing many detection patterns and gears having a small speed reduction ratio relative to the rotor 72, that is, by using photoreflectors of relatively high durability for noncontact detection in day detection using gears with small rotational torque (day wheels 89 and 92), and using spring switches of other calendar detection.

FIG. 10 shows both the electrical structure and mechanical structure of the wristwatch 1. As shown in the drawing, the wristwatch 1 includes the controller A, a power generator B, a power supply C, a hand drive D, the hand moving mechanism E, a date mechanism drive F, and automatic calendar mechanism (only the rotor 72 is shown).

The generator B generates an alternating current, and includes a rotor 45. The rotor 45 rotates in conjunction with movement, such as movement of the wrist of the user and the like, and the rotation (kinetic energy) of the rotor 45 is transmitted to a generator 40 through a step-up gear 46. The generator 40 includes a generator stator 42, a generator rotor 43 disposed to be rotatable within the generator stator 42, and a generating coil 44 electrically connected to the generator stator 42, such that the generator rotor 43 is rotated through the rotation (kinetic energy) of the rotor 45, and an alternating current is excited in the generating coil 44 through this rotation. In other words, while a user is wearing the wristwatch 1, power is generated through the rotation of the rotor 45 in conjunction with the movements of the user.

The power source C rectifies and stores the alternating current from the power generator B, boosts the stored power, and supplies the power to various structural components. Specifically, the power supply C includes a diode 47 which operates as a rectifier circuit, a large-capacity capacitor 48, and booster-reducer circuit 49. The booster-reducer circuit 49 is capable of boosting and reducing the voltage in multiple stages using three capacities 49*a*, 49*b*, and 49*c*, and regulates the voltage supplied to the hand drive D by controls signals from the controller A. Furthermore, the output voltage of the booster-reducer circuit 49 is supplied to the controller A through a monitoring signal, by means of which the controller A monitors the output voltage. The power supply C puts Vdd (high voltage side) to the reference potential (GND), and generates Vss (low voltage side) as a power source voltage.

The hand drive D supplies various drive pulses to the hand moving mechanism E under the control of the controller A. In the present embodiment, the hand moving mechanism D includes a second hand drive D1 to drive a second hand 61, and an hour-minute hand drive D2 to drive the hour hand 63, minute hand 62, and display hand 205*a* of the 24-hour display. More specifically, the second hand drive D1 includes a bridge circuit formed by a p-channel MOS 33*a* and n-channel MOS 32*a*, and p-channel MOS 33*b* and n-channel MOS 32*b* connected in series. The second hand drive D1 is further provided with circuit detection resistors 35*a* and 35*b* respectively connected in parallel to the p-channel MOS 33*a* and 33*b*, and sampling p-channel MOS 34*a* and 34*b* to supply chopper pulses to the resistors 35*a* and 35*b*. Accordingly, various drive pulses, for example, drive pulses having different polarities, can be supplied to the second hand moving mechanism E1, which forms part of the hand moving mechanism E, by applying control pulses from the controller A having different pulse widths and polarities at individual timings to the gate electrodes of the MOS 32*a*, 32*b*, 33*a*, 33*b*, 34*a*, 34*b*.

Furthermore, the hour-minute hand drive D2 is structured similar to the second hand drive D1, and supplies various drive pulses, for example pulses having different polarities, to the hour-minute hand moving mechanism E2, which forms part of the moving mechanism E, by applying control pulses from the controller A having different pulse widths and polarities.

The hand moving mechanism E includes the second hand moving mechanism E1 and the hour-minute hand moving mechanism E2. The second hand moving mechanism E1 includes a stepping motor 10, such that the second hand 61 is rotated by the stepping motor 10. Specifically, the stepping motor 10 is provided with a drive coil 11 to generate a magnetic force by the drive pulse supplied from the second hand drive D1, stator 12 which is excited through the drive coil 11, and rotor 13 which rotates by way of the magnetic field excited in the stator 12. Furthermore, the stepping motor 10 is a PM-type motor (permanent magnet rotary-type) in which the rotor 13 is formed by a disk-like permanent magnet with two poles. A magnetic saturation unit 17 is provided in the stator 12 such that the different magnetic poles generate their respective phases (poles) 15 and 16 around the rotor 13 via the magnetic force generated by the drive coil 11. An internal notch 18 is provided at a suitable position on the inner surface of the stator 12 to regulate the rotation direction of the rotor 13, to generate a cogging torque and stop the rotor 13 at an appropriate position. The rotation of the rotor 13 of the stepping motor 10 is transmitted to the second hand 61 through a wheel train 50, which includes a second wheel 52, and second intermediate wheel 51, which engages the rotor 13 through a pinion, to drive rotationally the second hand 61.

The hour-minute hand drive E2 is provided with a stepping motor 20; the hour hand 63 and display hand 205*a* of the 24-hour display are rotated in linkage with the rotation of the minute hand 62 by the stepping motor 20 driving the minute hand 62. Specifically, similar to the stepping motor 10, the stepping motor 20 is provided with a stator 22 and rotor 23, and a magnetic saturation unit 27A is provided in the stator 22 such that the different magnetic poles generate their respective phases (poles) 25 and 26 around the rotor 23 via the magnetic force generated by the drive coil 21. An internal notch 28A is provided at a suitable position on the inner surface of the stator 22 to regulate the rotation direction of the rotor 23, to generate a cogging torque and to stop the rotor 23 at an appropriate position.

The rotation of the rotor 23 of the stepping motor 20 is transmitted to each hand through a wheel train 30, which includes a fourth wheel 26 that engages the rotor 23 through a pinion, a third wheel 27, a second wheel 28, a day back wheel 29, a barrel wheel (hour indicator wheel), a barrel wheel 93*a*, a 24-hour detection wheel 94, and a 24-hour wheel 95. The minute hand 62 is connected to the second wheel 29, and the display hand 205*a* is connected to the 24-hour wheel 95. The hour and minute are displayed by the hands in linkage with the rotation of the rotor 23.

The date mechanism drive F generates an oscillation in the piezo-electric actuator 71 by applying an alternating current voltage to the piezo-electric element of the piezo-electric actuator 71 under the control of the controller A, such that a rotor 72 is rotated by the oscillation of the piezo-electric element thrusting the outer edge of the rotor 72, and the automatic calendar mechanism is driven in this manner. It is desirable that the date mechanism drive F is arranged opposite the hand moving mechanism E mediated by the ground plate.

Figure 12:
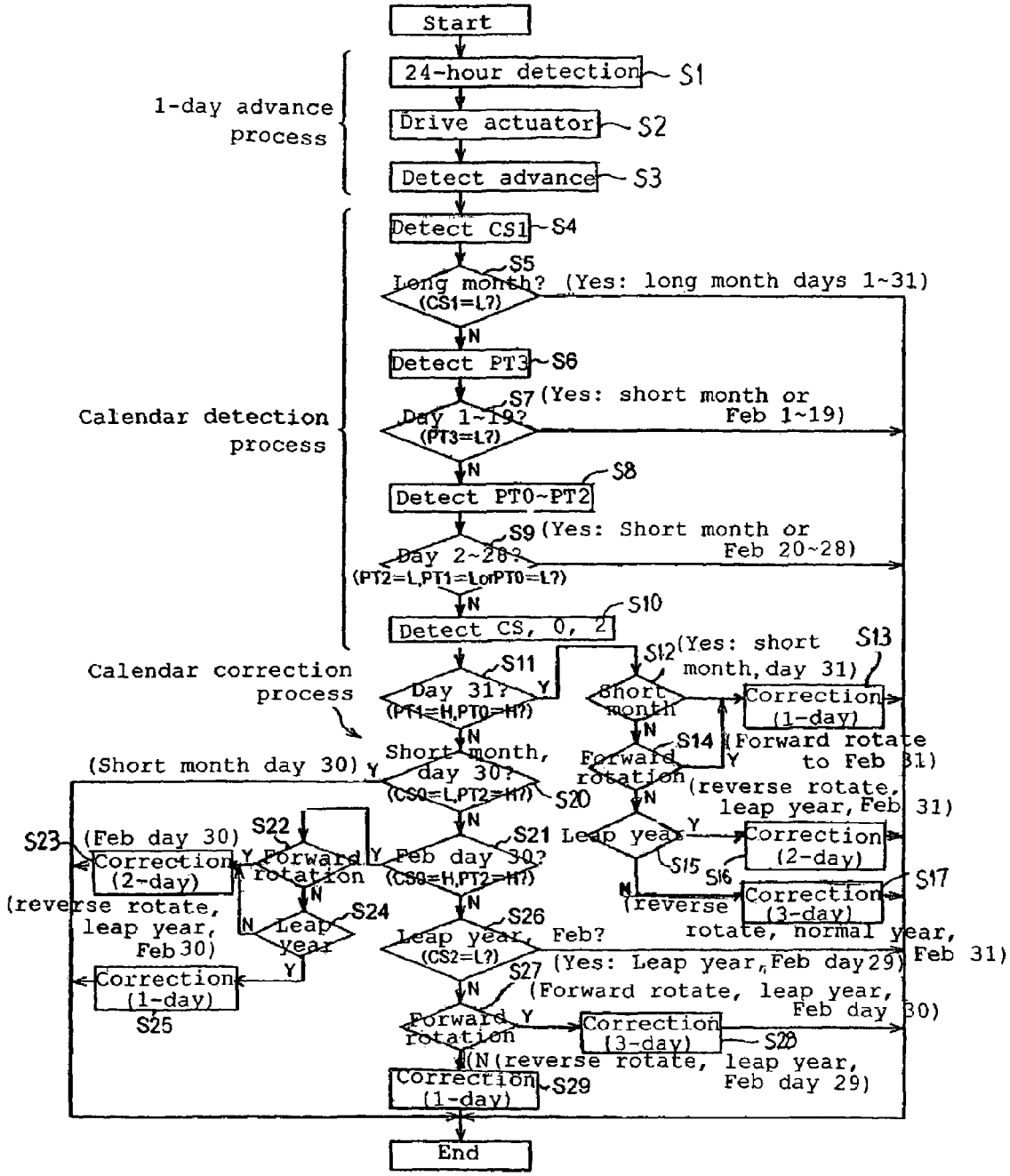
FIG. 12 is a view of a flow chart showing the calendar advance process of the wristwatch.
Figure 13:
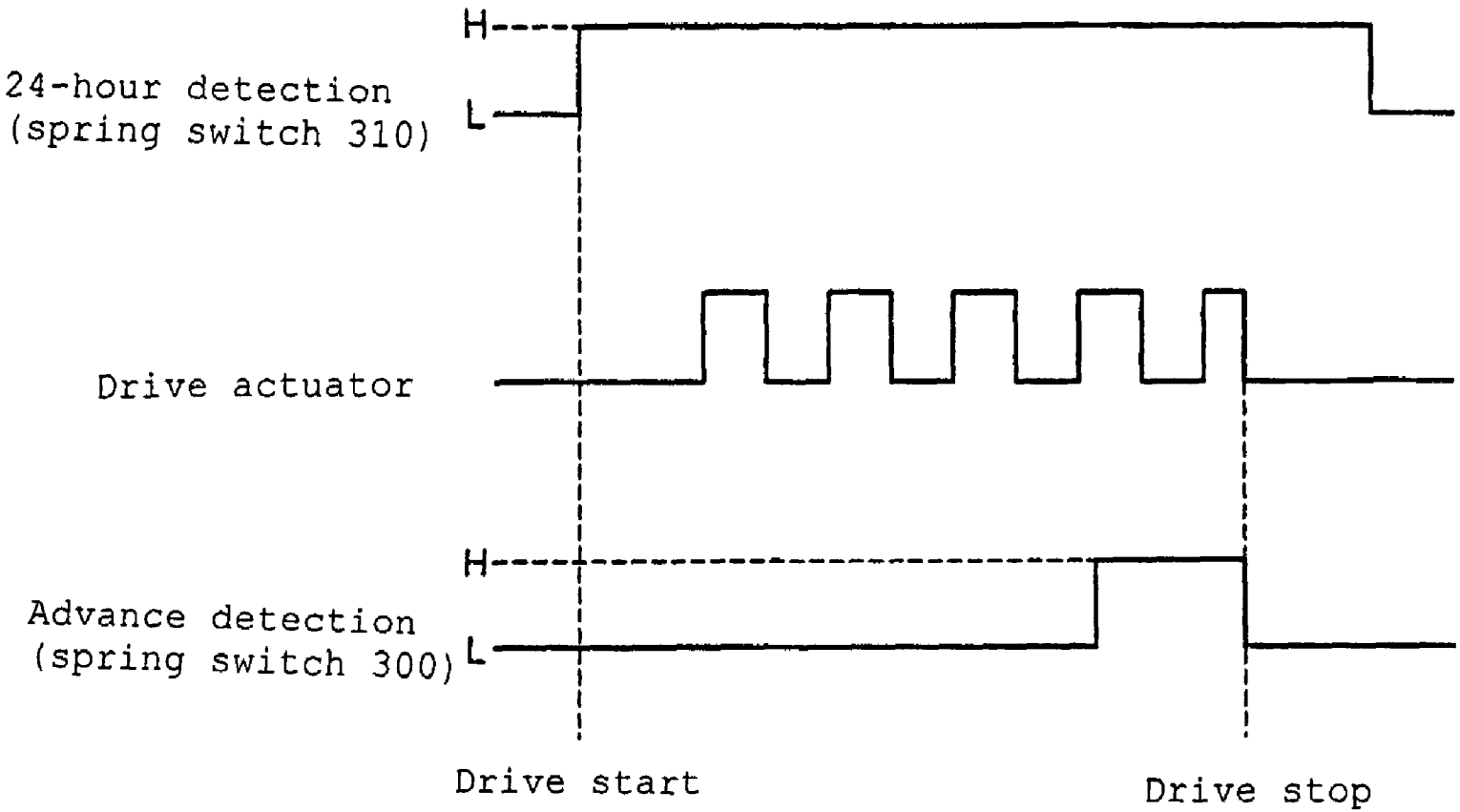
FIG. 13 is a view of a timing chart showing a one-day advance process of the wristwatch.

FIG. 11 is a block diagram of the functional structure of the controller A. The controller A controls the various parts of the wristwatch 1, and includes a watch controller A1 to control the hand drive D and hand moving mechanism E, and a calendar controller A2 to execute the calendar advance process to control the automatic calendar mechanism. The calendar controller A2 is electrically connected to the previously mentioned spring switches 300, 310, 320, 321, and 332, and the photoreflectors 100, 101, 102, and 103 (represented by PR in the drawing). When the spring switch 300 provided on the 24-hour detection wheel 94 is in a closed state, the one-day advance process to rotate the automatic calendar mechanism only one day, the calendar detection process to detect the advanced day and to determine whether that day is a nonexistent day, and the calendar correction process to drive the automatic calendar mechanism to display a valid day when a nonexistent day is determined, that is, so-called end of the month correction, are executed as the calendar advance process. FIG. 12 is a view of a flow chart showing the calendar advance process. FIG. 13 is a view of a timing chart in the case of the one-day advance process during the calendar advance process. First, as shown in FIGS. 10 to 13, when the time changes to 12 o'clock midnight, the calendar controller A2 detects that the terminal connected to the spring switch 310 changes to H-level when the spring switch 310 provided on the 24-hour detection wheel 94 closes (Step S1), and a day advance signal (start signal) is output to the date mechanism drive F. In this case, the rotor 72 is rotated and the automatic calendar mechanism is driven by the alternating current signal to drive the piezo-electric actuator 71 output from the date mechanism drive F (step S2). Then, the rotor 72 advances an amount equivalent to one day, the spring switch 300 for the detection of the advancement of the rotor 72 switches from open to closed, and when the change of the terminal connected to the spring switch 300 from L-level to H-level is detected, a stop signal is output to the date mechanism drive F to stop the drive of the automatic calendar mechanism (step S3). The process described above is the one-day advance process. Since the amount by which the rotor 72 advances is detected by the spring switch 300 when the piezo-electric actuator 71 is operating, it is possible to reduce the power consumption when simultaneously driving the piezo-electric actuator 71 and detecting the advance of the rotor 72 compared to when the advance of the rotor 72 is detected by the photoreflectors, which consume relatively large amounts of power.

Next, the calendar controller A2 executes the calendar detection process. Specifically, the calendar controller A2 first detects the terminal CS1 (step S4), and determines whether the currently displayed month is a long month based on the detected electric potential (H-level or L-level) (step S5). Specifically, as shown in FIG. 7, the calendar controller A2 determines the month is a long month when the terminal CS1 is set at L-level. Since a long month has no nonexistent days, when a long month is determined, the current day can be displayed and the calendar controller A2 ends the calendar advance process.

When it is determined in step S5 that the currently displayed month is not a long month (that is, when the terminal CS1 is set at H-level, which is equivalent to set calendar information that end of the month correction is required), the calendar controller A2 drives the photoreflector corresponding to terminal PT, and detects the detection result of the photoreflector through the terminal PT (step S6). Then, the calendar controller A2 determines whether the currently displayed day is day 1-19 based on the detected potential (step S7). Specifically, as shown in FIG. 9, when the terminal PT3 is set at L-level, the calendar controller A2 determines that the currently displayed day is day 1-19 because the value of the tens-column of the day is 0 or 1. When day 1-19 is determined, the day does not require end of the month correction, that is, it is determined that an existing day is displayed and the calendar controller A2 ends the calendar advance process.

Referring again to FIGS. 10 to 13, when it is determined in step S7 that the currently displayed day is not day 1-19 (that is, when the terminal PT3 is set at H-level, which is equivalent to set calendar information that end of the month correction is required), the calendar controller A2 drives the photoreflectors corresponding to terminals PT0-PT2, and detects the detection result of the photoreflectors through the terminals PT0-PT2 (step S8). It is desirable that these photoreflectors are driven with staggered timing. Exceeding the rated current of the drive power source can be easily avoided by staggering the timing to drive the photoreflectors. Then, the calendar controller A2 determines whether the currently displayed day is day 20-28 based on the combined detection results of the terminals PT0-PT2 (step S9). Specifically, as shown in FIG. 9, when the terminal PT2 is set at L-level and terminal PT1 is set at H-level or terminal PT0 is set at L-level, the calendar controller A2 determines that the currently displayed day is day 20-28. When day 20-28 is determined, the day invariably exists in both long months and short months, such that when an existing day is determined the calendar controller A2 ends the calendar advance process. In other words, the calendar controller A2 first determines whether the currently displayed month is a long month, and detects the day only when the displayed month is not a long month. Accordingly, since day and year detection are not performed when the currently displayed month is a long month, it is possible to conserve the power required for that part of the calendar detection. Furthermore, when the displayed month is not a long month, the calendar controller A2 determines whether the currently displayed day is day 1-19 from the detection result obtained by driving only one photoreflector, that is, the controller A2 determines whether the tens-column of the day is 1 or 0 which invariably exists in short months and long months, such that detection of the ones-column by driving the other photoreflectors is performed only when the determination is not 1 or 0. Accordingly, since detecting the tens-column of the day is unnecessary when the ones-column of the day is 1 or 0, it is possible to conserve the power required for that part of the calendar detection.

When it is determined in step S9 that the currently displayed day is not day 20-28 (that is, when the day is equivalent to set calendar information requiring end of the month correction), the calendar controller A2 detects the terminals CS0 and CS2 (step S10), and detects all of the currently displayed year, month, and day. The above process is the calendar detection process. The calendar correction process is described below.

First, the calendar controller A2 determines whether the currently displayed day is day 31 based on the detected year, month, day. Specifically, as shown in FIG. 9, the controller A2 determines whether the terminals PT1 and PT0 are set at H-level (step S11). Referring again to FIGS. 10 to 13, when day 31 is determined, the calendar controller A2 determines whether the currently displayed month is a short month excluding February. Specifically, the controller A2 determines whether the terminals CS1 and CS0 are set at H-level (step S12). Since the displayed day is determined to be a nonexistent day when a short month excluding February is determined, a day advance signal is output to the date mechanism drive F to rotate the automatic calendar mechanism the equivalent of one day (step S13) to display a valid day, and the calendar advance process ends.

In the wristwatch 1, functions are provided to switch the operating mode from a normal operating mode to a power conservation mode designed to conserve power by stopping the drives of the hand moving mechanism E and automatic calendar mechanism when the generator B does not generate for a continuous predetermined time (for example, three minutes), and, when power generation by the generator B is detected, to operate the hand moving mechanism E at high speed until the current time measured by an internal clock circuit is displayed, and rotate the automatic calendar to advance the date by the number of days elapsed in the conservation mode to restore the current time and calendar date.

In this restoration, for example, the automatic calendar mechanism is driven in forward rotation which is the same rotation direction as the normal calendar advance when the conservation mode period is less than two years, whereas the automatic calendar is driven in reverse rotation when, for example, the conservation mode period is more than two years such that high-speed restoration and power conservation are both realized by driving the rotation of the automatic calendar mechanism in the rotation direction that requires the least rotation. However, since the restoration of the automatic calendar mechanism simply advances the date by the number of elapsed days in the power conservation mode without regard to end of the month correction, dates such as February 31, February 30, and normal year February 29 may be displayed.

The process of step S4 is also executed when performing the restoration operation in the present embodiment, and the calendar correction process is stipulated in consideration of this situation.

Specifically, in the process of step S12, when it is determined that February 31 is displayed rather than a short month excluding February, the calendar controller A2 determines whether the rotation direction during restoration by the automatic calendar mechanism was forward rotation (normal rotation) (step S14), and moves to step S13 when the rotation was forward, and after rotating the automatic calendar mechanism one day to display March 1, the calendar advance process ends. When forward rotation is not determined, the calendar controller A2 determines whether the year is a leap year based on the detection result of terminal CS2 (step S15), and in the case of a leap year, the automatic calendar mechanism is rotated in reverse two days and February 29 is displayed (step S16), whereas in a non-leap year, the automatic calendar mechanism is rotated in reverse three days and February 28 is displayed (step S17), whereupon the calendar advance process ends. Consequently, it is possible to correct the date by forward and reverse rotation to a suitable existing day even when February 31 is displayed. Furthermore, the processes of steps S15 through S17 may be omitted in wristwatches that are not provided with the conservation mode function.

When the determination in step S11 is not day 31, the calendar controller A2 determines whether the current day is day 30 of a short month excluding February. In other words, specifically, the controller A2 determines whether the terminal CS0 is set at L-level and the terminal PT2 is set at H-level (step S20). When day 30 of a short month excluding February is determined, the calendar controller A2 ends the calendar advance process because an existing day is displayed.

When it is determined in step S20 that it is not day 30 of a short month excluding February, the calendar controller A2 determines whether the day is February 20. in other words, that is, specifically, the controller A2 determines whether the terminal CS0 is set at H-level and the terminal PT2 is set at H-level (step S21). When February 30 is determined, the calendar controller A2 determines whether the rotation direction during restoration by the automatic calendar mechanism was forward rotation (normal rotation) (step S22), and after rotating the automatic calendar mechanism two days to display March 1 (step S23), the calendar advance process ends.

When non-forward rotation (reverse rotation) is determined, the calendar controller A2 determines whether the year is a leap year based on the detection result of the terminal CS2 (step S24); when it is not a leap year, the process moves to step S22, and the automatic calendar mechanism is rotated in reverse two days and February 28 is displayed, whereas when the year is a leap year, the automatic calendar mechanism is rotated in reverse one day and February 29 is displayed (step S25), whereupon the calendar advance process ends. Consequently, it is possible to correct the date by forward and reverse rotation to a suitable existing day even when February 30 is displayed. Furthermore, the processes of steps S20 through S25 may be omitted in wristwatches that are not provided with the conservation mode function.

When it is determined in step S21 that it is not February 30, the calendar controller A2 determines whether the month is February of a leap year. In other words, specifically, the controller A2 determines whether the terminal CS2 is set at L-level (step S26), and when February of a leap year is determined, the calendar advance process ends because an existing day is displayed.

When it is determined in step S26 that it is not February of a leap year, the calendar controller A2 determines whether the rotation direction during restoration of the automatic calendar mechanism was forward rotation (normal rotation) (step S27). In the case of forward rotation, the calendar controller A2 rotates the automatic calendar mechanism three days and March 1 is displayed, whereas in the case of reverse rotation, the automatic calendar is rotated one day and February 28 is displayed (step S29), whereupon the calendar advance process ends. Consequently, it is possible to correct the date by forward and reverse rotation to a suitable existing day even when February 29 is displayed. Furthermore, the processes of steps S27 through S29 may be omitted in wristwatches that are not provided with the conservation mode function.

Therefore, the wristwatch 1 of the present embodiment not only reduces power consumption when driving the piezo-electric actuator 71 and rotating the piezo-electric rotor 72 by detecting the amount of advance of the piezo-electric rotor 72 by the spring switch 300 and stopping the piezo-electric actuator 71 compared to when the amount of advance of the piezo-electric rotor 72 is detected using photoreflectors, but also greatly reduces current consumption when the piezo-electric actuator 71 is driven simultaneously with the detection of the advance of the piezo-electric rotor 72. Consequently, it is possible to avoid reliably having the current consumption of the wristwatch 1 exceed the rated current of a secondary battery (large capacity capacitor 48). Furthermore, since the spring switch 300 is provided on the intermediate wheel 75 of the reduction gear train medial to the piezo-electric rotor 72 and control wheel 78, the torque load of the spring switch 300 is suppressed to a degree that does not impair the drive of the automatic calendar mechanism.

The embodiment described above provides a calendar detection mechanism having excellent durability, torque load reduction, and power consumption reduction by utilizing many detection patterns and photoreflectors in day detection using gears having a small speed reduction ratio (small rotational torque) relative to the piezo-electric rotor 72, and using spring switches for other calendar detection (month detection, year detection), advance detection of the piezo-electric rotor 72, and 24-hour detection. In other words, using spring switches in day detection having many light detection patterns is disadvantageously inasmuch as the durability of the spring switches is reduced in a short time because the spring switches open and close many times. Furthermore, spring switches have a marked influence on torque load because the gears provided with the spring switches have low rotational torque, and as a result, the power consumption by the piezo-electric actuator 71 increases. However, these disadvantages are eliminated in the present embodiment.

Chip dust generation can be suppressed and stopping and divergent indication by the hand moving mechanism E of the timepiece can be prevented because the number of operations of the spring switches are reduced when the spring switches are used for calendar detection (month detection, year detection). Since the date mechanism drive F is arranged opposite the hand moving mechanism E mediated by the ground plate, it is difficult for chip dust to penetrate to the hand moving mechanism E. Moreover, since the number of operations of the spring switches is reduced, the stress tolerance can be increased, the spring switches and spring contacts can be thin and compact, and the calendar display mechanism can have a thinner and more compact form.

According to the wristwatch 1 of the present embodiment, since the calendar controller A2 detects other calendar information (day and year) and determines whether the displayed date is an existing day only when the current month is detected and it is determined that the current month is not a long month (that is, a short month), the day and year are not detected when the currently displayed month is a long month. Accordingly, the power consumption necessary for calendar detection can be reduced. The calendar controller A2 detects the tens-column of the displayed day, and determines whether the value of the tens-column of that day is 1 or 0, which invariably exists in short months and long months, and when the tens-column of the currently displayed day is 1 or 0, and only then, the ones-column value of the day is not detected. Accordingly, the power consumption necessary for calendar detection can be reduced. In the present embodiment, power required for calendar detection can be efficiently reduced because detection of the ones-column and tens-column of the day are accomplished using photoreflectors which have relatively high power consumption.

As used herein, the following directional terms "forward, rearward, above, downward, vertical, horizontal, below, and transverse" as well as any other similar directional terms refer to those directions of a device equipped with the present invention. Accordingly, these terms, as utilized to describe the present invention should be interpreted relative to a device equipped with the present invention.

Second Embodiment

A second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The wristwatch of the second embodiment is substantially similar to or the same as the wristwatch 1 of the first embodiment with the main exception that the structure relating to the ones-column day detection differs. In the following description, like parts are designated by like reference numbers, and detailed description of like parts is omitted.

Figure 14A:
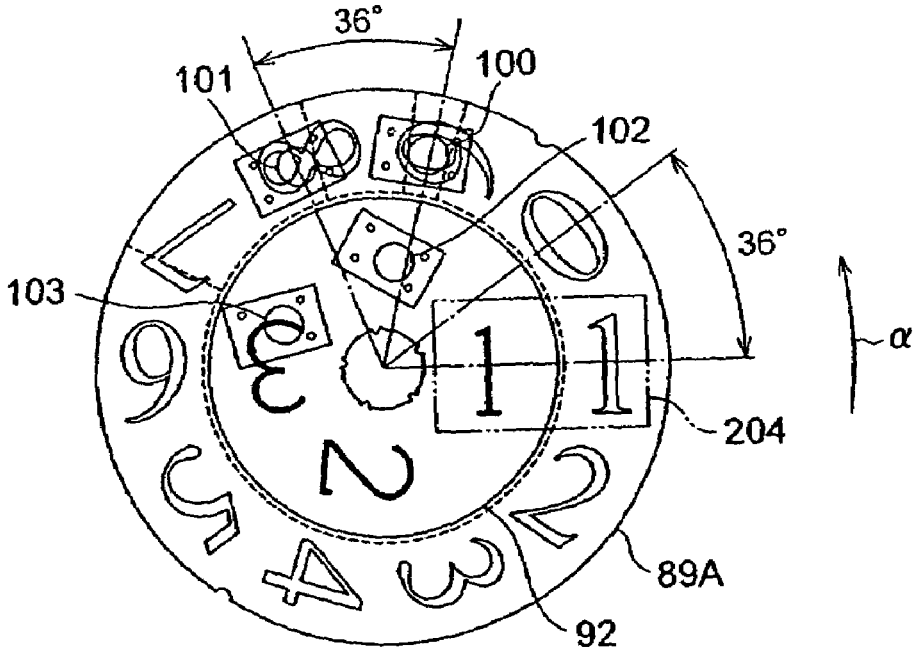
FIG. 14A is a view from the front of a day wheel of a ones-column place value and the day wheel of the tens-column place value of the wristwatch in accordance with a second preferred embodiment of the present invention.
Figure 14B:
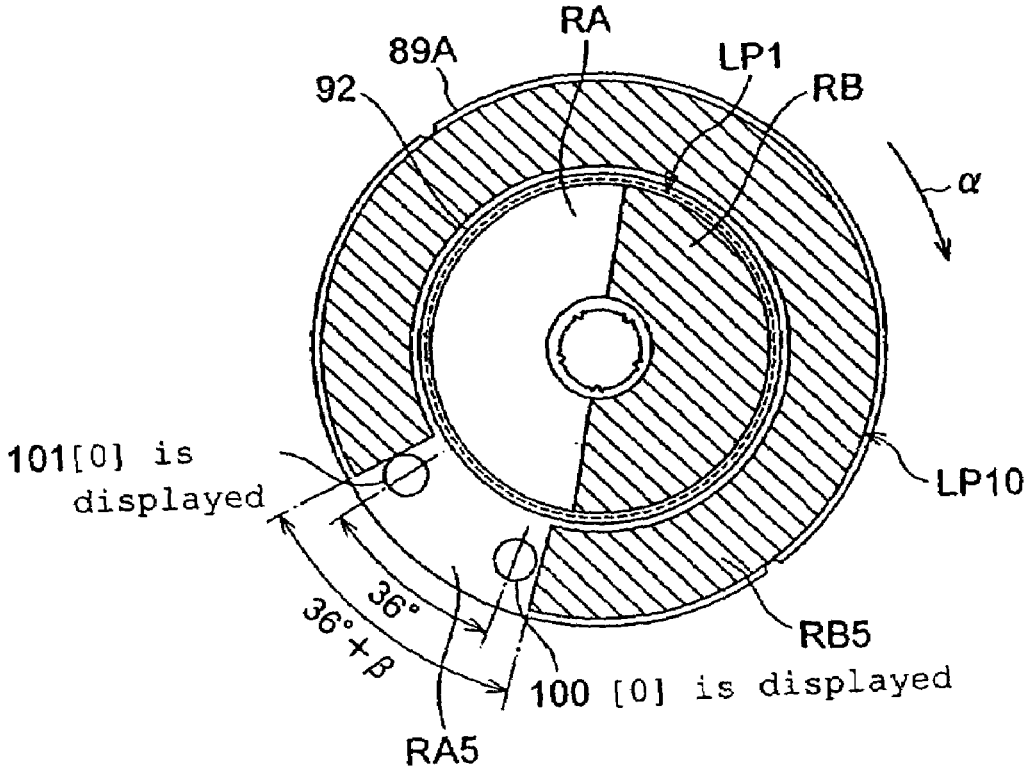
FIG. 14B is a view from the back of the day wheel of the ones-column place value and the day wheel of the tens-column place value of the wristwatch of the second embodiment.

FIG. 14A shows the front of a ones-column day wheel 89A, and FIG. 14B shows the back of the day wheel 89A. A light detection pattern LP10 is provided on the back surface of the ones-column day wheel 89A, and photoreflectors 100 and 101 to illuminate light on the light detection pattern LP10 and to receive the detected light are provided on the back side of the day wheel 89A. The photoreflectors 100 and 101 are arranged to be separated by an open space on a common circle periphery in the rotation direction α of the day wheel 89A. Further, this space is identical to the layout spacing of the 0-9 provided on the front of the day wheel 89A, that is, this spacing is set at 36° (360°/10).

The light detection pattern LP10 is a reflective pattern in which the illumination regions of both photoreflectors 100 and 101 become reflective region RA5 when the day displayed in the day display window 204 of the day wheel 89A is day 0. The reflective region RA5 is provided in a range of 36°+β (where β is an angle covering the illumination region of the photoreflectors 100 and 101) relative to the rotational axis of the day wheel 89A to extend across the illumination range of the photoreflectors 100 and 101 when 0 is displayed. Furthermore, the light detection pattern LP10 is provided with a nonreflective region RB5 extending across the illumination region of the photoreflectors 100 and 101 outside the reflective region RA5. The photoreflector 100 is connected to the terminal PT0 of the controller A, and the photoreflector 101 is connected to the terminal PT1 of the controller A.

According to this structure, when the displayed ones-column day is 2-8, the levels of the terminals PT0 and PT1 (hereinafter referred to as 'PT0 and PT1') are both L-level, as shown in the day information detection pattern of FIG. 15. This state is written (PT0, PT1)=(L, L). When the displayed ones-column day is 9, (PT0, PT1)=(H, L). When the displayed ones-column day is 0, (PT0, PT1)=(H, H). When the displayed ones-column day is 1, (PT0, PT1)=(L, H).

Accordingly, the combinations of the levels of (PT0, PT1) mutually differ when the displayed ones-column day is 2-8, 9, 0, 1, and whether the displayed ones-column day is 2-8, 9, 0, 1 can be discriminated through the light detection pattern LP10.

In the present embodiment, the light detection pattern LP10 having a reflective region RA5 extending across the illumination ranges of the photoreflectors 100 and 101 to position the reflective range at the illumination range of the two photoreflectors 100 and 101 when the displayed ones-column day is 0, and therefore whether the displayed ones-column day is 2-8, 9, 0, or 1 can be discriminated, and the surface area of the reflective range can be widely ensured compared to the light detection pattern LP2 (FIG. 8B) of the day wheel 89 of the first embodiment. In this case, since the layout spacing of the photoreflectors 100 and 101 matches the layout spacing of the numerals 0-9 provided on the day wheel 89A, the layout of the photoreflectors 100 and 101 is simple.

The embodiments described above is one mode of the invention, and the invention may be variously modified within the scope of the claims. For example, although the above embodiments have been described in terms of displaying the ones-column and tens-column of a day using separate day wheels, the day may also be displayed by providing numerals 1-31 on a single day wheel. In this case, two photoreflectors are arranged on the board opposite the back side of the day wheel separated by an open space on a common circle periphery in the rotation direction of the day wheel, and provided on the back surface of the day wheel is a light detection pattern which allows the displayed day to be discriminated as 1-28, 29, 30, and 31.

FIGS. 16 and 17 show examples the day information detection patterns in this case. Since the day information detection patterns shown in FIGS. 16 and 17 have different PT1 and PT0 levels depending on whether the displayed day is 1-28, 29, 30, and 31, it is possible to discriminate 1-28, 29, 30, and 31 based on the 2-bit information of the patterns.

When this structure is used, whether the day is day 1-28 may be determined based on the detection results of the terminals PT1 and PT0, such that when the day is day 1-28, the year detection is not performed and the calendar advance process ends, and this process may be substituted for processes of steps S7 and S9 in the calendar advance process described above. Consequently, when the displayed day is day 1-28, the year detection is unnecessary, and power consumption may be conserved in proportion to the omitted year detection.

The day information detection pattern shown in FIG. 16 is identical to the modified pattern 2→8→9→0→1 (refer to FIG. 9) shown in the first embodiment, and therefore the light detection pattern realized by this day information detection pattern is basically identical to the light detection pattern LP2 shown in the first embodiment. Consequently, a reflective region used by only one photoreflector is required, and when one day wheel is provided with numerals 1-31, the range of the reflective region is narrower, that is, a range of less than approximately 5.8° (360°/31/2), or half the numeral interval spacing of the day wheel.

In contrast, the day information detection pattern shown in FIG. 17 is identical to the modified pattern 2→8→9→0→1 (refer to FIG. 15) shown in the second embodiment, and therefore the light detection pattern realized by this day information detection pattern is basically identical to the light detection pattern LP10 shown in the second embodiment. Specifically, this light detection pattern includes a reflective region extending across the illumination region of two photoreflectors when the displayed day is 30, and a nonreflective region extending across the illumination region of the photoreflectors outside the reflective region, and the layout spacing of the two photoreflectors is identical to the layout spacing of the days provided on the wheel. Accordingly, a wide reflective region surface area is ensured compared to FIG. 16, and the layout of the photoreflectors is simple.

Although the above embodiments have been described in terms of first detecting the currently displayed month, and detected other calendar information (day, year) only when the current month is determined to be a short month rather than a long month in the determination of whether the date is a valid existing day, it is also possible to first detect the day, then determine the whether the current day is equivalent to day 29-31 (set calendar information) that do not exist in short months, and to then detect the month only after day 29-31 has been established as the current day. For example, in the flow chart shown in FIG. 11, the process of step S5 may be executed after the process of step S9. In this case, when the currently displayed day is day 1-28, the month and year detection need not be performed such that it is possible to conserve the power required for that part of the calendar detection.

Although the above embodiments have been described in terms of using photoreflectors in day detection employing many detection patterns and gears having a small rotational torque, the present invention is not limited to the use of photoreflectors for day detection inasmuch as the automatic calendar mechanism may be suitably modified for the use of photoreflectors in conjunction with detection using only a plurality of detection patterns or detection using only gear having a small rotational torque. Furthermore, although the above embodiments are described in terms of day detection accomplished by providing light detection patterns on a day wheel and reading the patterns using photoreflectors, day detection also may be accomplished by providing magnetic detection patterns on a day wheel and reading the patterns using a magnetic head or the like (magnetic reading means).

Moreover, detection methods other than optical detection and magnetic detection also may be applied, including various noncontact detection methods such as electrostatic capacitance detection and the like. In the case of magnetic detection, a plurality of hard magnetic thin film patterns may be provided on a clock wheel and a Hall element may be arranged on a board opposite the wheel to detect the magnetic information from the hard magnetic thin film pattern. The Hall element control current flows to the Hall element by means of bonding wire wiring, and the Hall element electromotive force is measured. Since the Hall element and hard magnetic thin film pattern are noncontact, there is no effect on the hand movement. The Hall element can be easily introduced into the watch movement, particularly in the case of a nonpackage-type GaAs Hall element having an extremely small thickness at 300×300×150 μm, such that the watch thickness is unaffected.

The above embodiments have been described by way of examples using a spring switch as a mechanical switch, however, other types of mechanical switches may be substituted for the spring switch. Although the automatic calendar mechanism is moved by a piezo-electric actuator 71 in the above embodiments, the automatic calendar mechanism also may be moved by substituting another drive device, such as a motor or the like, for the piezo-electric actuator 71. Although the present invention is applied to timepieces provided with a day display window 204, 24-hour display 205, month display 206, and year display 208 in the above embodiments, the invention is also applicable to timepieces which display only the day and timepieces which display days of the week, and it is to be understood that the various displays are optional. The invention in the above embodiments is described in terms of the solar calendar, however, the invention also may be used with a lunar calendar.

The examples in the previously described embodiments concern structures providing a rotor 45 on a generator B to generate power from the rotation (kinetic energy) of the rotor 45, however, the generator B, for example, may generate power by natural energy, such as solar power generation, thermal power generation and the like. Although power from a generator is supplied to the various parts of the wristwatch 1 in the examples above, the wristwatch 1 also may be provided with a primary battery instead of the generator. Although the present invention is applied to a wristwatch in the above embodiments, the invention is also applicable to portable timepieces such as pocket watches and the like, and stationary timepieces, such as table clocks and the like. Regardless of whether the timepiece is portable or stationary, the present invention is also applicable to radio clocks which correct the time by receiving radio waves (for example, JJY) representing the standard time.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application Nos. 2004-043497, 2004-043462, and 2004-297139. The entire disclosure of Japanese Patent Application Nos. 2004-043497, 2004-043462, and 2004-297139 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An electronic timepiece comprising:

a rotor;

a calendar display mechanism having a calendar display function to display a calendar including day, month, and year, said calendar display mechanism being configured to rotate one or a plurality of calendar display wheels by a rotational drive of said rotor through a gear train, said calendar display wheels including a day wheel displaying said day;

an piezoelectric actuator being configured to rotate said rotor;

a gear being configured in said gear train;

a mechanical switch being configured to operate in conjunction with rotation of said gear, an amount of rotation of said rotor being detected by a detecting operation of said mechanical switch;

a plurality of detection wheels formed on said calendar display wheels or said gear that rotates in linkage with said calendar display wheels, said detection wheels including a month detection wheel for detection of month, and a year detection wheel for detection of year;

a control;

a noncontact detector being configured to perform noncontact-type detection of a rotation position of said day wheel; and a contact detector being configured to perform a contact-type detection of a rotation position of said month detection wheel, or said year detection wheel, said piezoelectric actuator being stopped based on a detection result of said amount of the rotation by said detecting operation of said mechanical switch, at least one of said day wheel, said month wheel, and said year wheel being detected to confirm whether or not further detection is necessary for end of month correction of said calendar, said control confirming whether or not said month has 31 days, said control confirming whether tens-column place value of said day is 1 or 0, after said month is confirmed to have fewer than 31 days, said control confirming what ones-column place value of said day is, after said tenth digit of said day is confirmed to be not 1 or 0, said control determining whether or not date including said month and said day exists, said control displaying an existing day instead of said date, if said date is determined to be nonexistent.

2. The electronic timepiece according to claim 1, wherein said mechanical switch includes a spring contact provided on said gear, and a conduction member that provides conduction through said spring contact in accordance with said rotation of said gear.

3. The electronic timepiece according to claim 1, wherein said gear is arranged in a reduction gear train.

4. The electronic timepiece according to claim 1, wherein said noncontact detector detects said day wheel to confirm whether or not a displayed day conforms to detection patterns including 31, 30, 29, or 1-28, and when said displayed day conforms to a detection pattern of 1-28, said contact detector does not detect said month wheel in order to reduce current consumption.

5. The electronic timepiece according to claim 1, wherein said contact-type detector includes a spring contact provided on one of said detection wheels, and a conduction member that provides conduction through said spring contact in accordance with said rotation of said detection wheel, and said noncontact detector reads an optical detection pattern or magnetic detection pattern provided on said calendar display wheels or said gear by light detection or magnetic detection.

6. The electronic timepiece according to claim 1, wherein said noncontact detector detects electrostatic capacitance.

7. A control method for an electronic timepiece comprising:

providing a calendar display mechanism having a calendar display function to display a calendar by rotating one or a plurality of calendar display wheels by a rotational drive of a rotor through a gear train, said calendar display wheels including a day wheel displaying day;

detecting an amount of rotation of said rotor by detecting an operation of a mechanical switch operating in conjunction with rotation of one gear in said gear train to provide a detection result;

stopping a drive of a piezoelectric actuator being configured to rotate said rotor based on said detection result of said amount of the rotation by said detecting operation of said mechanical switch;

detecting said day based on a detection result by a noncontact detector provided for noncontact-type detection of a rotation position of said day wheel;

detecting a month or a year displayed by said plurality of calendar display wheels, based on a detection result of a contact detector provided for contact-type detection of a rotation position of a plurality of detection wheels formed of calendar display wheels or gears that rotate in linkage with said plurality of calendar display wheels, at least one of said day wheel, said month wheel, and said year wheel being detected to confirm whether or not further detection is necessary for end of month correction of said calendar, confirming whether or not said month has 31 days, confirming whether tens-column place value of said day is 1 or 0, after said month is confirmed to have fewer than 31 days, confirming what ones-column place value of said day is, after said tens-column place value of said day is confirmed to be not 1 or 0, determining whether or not date including said month and said day exists, displaying a day other which exists instead of said date, if said date is determined to be nonexistent.

8. An electronic timepiece with calendar display function, comprising:

a calendar display being configured to display a plurality of calendar information including day, month, and year;

a noncontact detector being configured to perform noncontact-type detection;

a contact detector being configured to perform contact-type detection;

a drive device being configured to drive said calendar display and to change said plurality of calendar information; and a control being configured to detect one bit of said plurality of calendar information, said control being configured to determine whether said one bit conforms to set calendar information requiring end of the month correction, said control being configured to detect other calendar information only when said one bit has been determined to conform to said set calendar information, and not to detect other calendar information when said one bit has been determined to conform said set calendar information in order to reduce current consumption, said control confirming whether or not said month has 31 days, said control confirming whether tens-column place value of said day is 1 or 0, only after said month is confirmed to have fewer than 31 days, said control confirming what ones-column place value of said day is, only after said tens-column place value of said day is confirmed to be not 1 or 0, said control being configured to determine whether date including said month and said day an existing day or nonexistent day, said control being configured to control said drive device to display an existing day on said calendar display when said date is nonexistent, said control detecting day by using said noncontact detector and detecting month or year by using said contact detector.

9. The electronic timepiece according to claim 8, wherein said control detects said day from among said plurality of calendar information displayed by said calendar display, said control detects other calendar information including month only when said day has been determined to conform to said set calendar information in which said day is a day that does not exist in a month having fewer than 31 days, and does not detect other calendar information when said day has been determined to conform to said set calendar information in which said day is a day that exits in a month having 31 days in order to reduce current consumption, said control determines whether said date including said month and day is an existing day or nonexistent day, and said control controls said drive device to display an existing day on display calendar display when a nonexistent day is determined.

10. The electronic timepiece according to claim 8, wherein said control detects said month from among a plurality of calendar information, said control detects other calendar information including said day only when said month has been determined to conform to said set calendar information in which said month is a month having fewer than 31 days, and does not detect other calendar information when said month has been determined to conform to said set calendar information in which said month is a month having 31 days in order to reduce current consumption, said control determines whether said date including said month and day is an existing day or nonexistent day, and said control controls said drive device to display an existing day on the calendar display when a nonexistent day is determined.

11. The electronic timepiece according to claim 10, wherein said control detects said year only when said detected month is February and said detected day is not a day between 1-28, and does not detect said year when said detected month is not February or said detected day is a day between 1-28 in order to reduce current consumption, said control determines whether said date representing said year, month, and day is an existing day or nonexistent day, and said control controls said drive device to display an existing day on said calendar display when a nonexistent day is determined.

12. The electronic timepiece according to claim 10, wherein said calendar display includes a tens-column place value display to display a tens-column value of said day, and a ones-column place value display to display a ones-column value of said day to display said day by said tens-column display and said ones-column display, and said control detects said tens-column value of said day, determines whether said tens-column value of said day conforms to a tens-column value of 1 or 0, detects said ones-column value of said day only when the tens-column value is not 1 or 0, and does not detect said ones-column value of said day when the tens-column value is 1 or 0 in order to reduce current consumption.

13. The electronic timepiece according to claim 10, wherein said calendar display includes a tens-column place value display to display a tens-column value of said day, and a ones-column place value display to display a ones-column value of said day to display said day by respectively rotating said tens-column display and said ones-column display, two first photoreflectors are arranged on a back side of said tens-column display separated by an open space on a common circle periphery in a rotation direction of said tens-column display, a first light detection pattern having a reflective region and nonreflective region provided on a back surface of the tens-column display such that detection results of said two first photoreflectors are different when said day displayed on said tens-column display is any among 0-10, 20, and 30; and two second photoreflectors are arranged on a back side of said ones-column display separated by an open space on a common circle periphery in a rotation direction of said ones-column display, and a second light detection pattern having a reflective region and nonreflective region provided on a back surface of said ones-column display such that detection results of said two second photoreflectors are different when said day displayed on said ones-column display is any among 2-8, 9, 0, and 1.

14. The electronic timepiece according to claim 13, wherein said two second photoreflectors are arranged with the same spacing as the spacing of the days of the ones-column provided on the ones-column display, and an optical detection pattern on the ones-column display includes a reflective region extending across an illumination range of said two second photoreflectors when a day displayed by the ones-column display is 0, and a nonreflective region extending across said illumination range of said two second photoreflectors outside said reflective region.

15. The electronic timepiece according to claim 10, further comprising a day display being included in said calendar display to display 1-31 days, and said day is displayed by rotating said day display, and two photoreflectors arranged on a back side of said day display separated by an open space on a common circle periphery in a rotation direction of said day display, and a light detection pattern having a reflective region and nonreflective region provided on a back surface of said day display such that detection results of said two photoreflectors are different when said day displayed on said day display is any among 10-28, 29, 30, and 31.

16. The electronic timepiece according to claim 15, wherein said two photoreflectors are arranged with the same spacing as the spacing of the days provided on said day display, and said optical detection pattern on said day display includes a reflective region extending across said illumination range of said two photoreflectors when said day displayed by said day display is 30, and a nonreflective region extending across said illumination range of said two photoreflectors outside said reflective region.

17. A control method for an electronic timepiece comprising:

displaying a plurality of calendar information including day, month, and year by a calendar display function of a calendar display;

driving said calendar display using a drive device;

changing said plurality of calendar information;

detecting one bit of calendar information among said plurality of calendar information;

determining whether said one bit of calendar information conforms to set calendar information requiring end of the month correction;

detecting other calendar information only when said one bit of calendar information has been determined to conform to said set calendar information;

pausing detecting other calendar information when said one bit of calendar information has not been determined to conform to said set calendar information in order to reduce current consumption;

detecting day displayed by said calendar display by using a noncontact detector performing noncontact-type detection;

detecting month or year displayed by said calendar display by using a contact detector performing contact-type detection;

confirming whether or not said month has 31 days, confirming whether tens-column place value of said day is 1 or 0, after said month is confirmed to have fewer than 31 days, confirming what ones-column place value of said day is, after said tens-column place value of said day is confirmed to be not 1 or 0, determining whether date including said month and said day is an existing day or nonexistent day; and controlling said drive device to display an existing day on said calendar display when said date is determined to be nonexistent.

18. The control method for an electronic timepiece according to claim 17, wherein said month is detected from among a plurality of calendar information displayed by said calendar display, other calendar information including said day is detected only when said month has been determined to conform to said set calendar information in which said month is a month having fewer than 31 days, other calendar information is not detected when said month has been determined to conform to said set calendar information in which said month is a month having 31 days in order to reduce current consumption, whether said date including said month and day is an existing day or nonexistent day is determined, and said drive device is controlled to display an existing day on said calendar display means when a nonexistent day is determined.

19. The control method for an electronic timepiece according to claim 17, wherein said day is detected from among said plurality of calendar information displayed by said calendar display, other calendar information including said month is detected only when said day has been determined to conform to said set calendar information in which said day is a day that does not exist in a month having fewer than 31 days, and is not detected when said day has been determined to conform to said set calendar information in which said day is a day that exists in a month having fewer than 31 days in order to reduce current consumption, whether said date including said month and day is an existing day or nonexistent day is determined, and said drive device is controlled to display an existing day on said calendar display when a nonexistent day is determined.

20. The control method for an electronic timepiece according to claim 18, wherein said year is detected only when said detected month is February and said detected day is not a day between 1-28, said year is not detected when said detected month is not February or said detected day is a day between 1-28 in order to reduce current consumption, whether said date representing said year, month, and day is an existing day or nonexistent day is determined, and said drive device is controlled to display an existing day on said calendar display when a nonexistent day is determined.

21. The control method for an electronic timepiece according to claim 18, wherein said calendar display includes a tens-column place value display to display a tens-column value of said day, and a ones-column place value display to display a ones-column value of said days to display said day by said tens-column display and said ones-column display, when detecting said day, said tens-column value of said day is detected, whether or not said tens-column value of said day conforms to a tens-column value of 1 or 0 is determined, said ones-column value of said day is detected only when said tens-column value is not 1 or 0, and said ones-column value of said day is not detected when said tens-column value is 1 or 0.

22. The control method for an electronic timepiece according to claim 18, wherein said noncontact detector detects electrostatic capacitance.

* * * * *